US007172532B2

(12) United States Patent
Baker

(10) Patent No.: US 7,172,532 B2
(45) Date of Patent: Feb. 6, 2007

(54) EXERCISE DEVICE TUBING

(75) Inventor: William A. Baker, Longmont, CO (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 10/890,617

(22) Filed: Jul. 13, 2004

(65) Prior Publication Data

US 2004/0248701 A1 Dec. 9, 2004

Related U.S. Application Data

(62) Division of application No. 10/051,602, filed on Jan. 17, 2002.

(60) Provisional application No. 60/262,768, filed on Jan. 19, 2001.

(51) Int. Cl.
*A63B 22/06* (2006.01)

(52) U.S. Cl. ..... 482/57; 403/109.1

(58) Field of Classification Search ..... 482/38, 482/42, 51, 57–62, 148, 908; 403/109.1, 403/109.3, 109.6
See application file for complete search history.

(56) References Cited

U.S. PATENT DOCUMENTS

| | | | |
|---|---|---|---|
| 326,247 | A | 9/1885 | Root |
| 334,635 | A | 1/1886 | Bowen |
| 402,926 | A | 5/1889 | Haynes, Jr. |
| 518,411 | A | 4/1894 | Casse |
| 562,198 | A | 6/1896 | Robinson |
| 572,273 | A | 12/1896 | Peterson |
| 581,095 | A | 4/1897 | Willard |
| 588,166 | A | 8/1897 | McCoy |
| 633,534 | A | 9/1899 | Read |
| 635,082 | A | 10/1899 | Stiles |
| 642,919 | A | 2/1900 | Nott |
| 671,785 | A | 4/1901 | Young et al. |
| 681,565 | A | 8/1901 | McCune et al. |
| 747,294 | A | 12/1903 | Blaisdell |
| 763,095 | A | 6/1904 | Ebken |
| 998,365 | A | 7/1911 | MacLean |
| 1,245,350 | A | 11/1917 | Hurwitz |

(Continued)

FOREIGN PATENT DOCUMENTS

| | | |
|---|---|---|
| AT | 209202 | 5/1960 |

(Continued)

OTHER PUBLICATIONS

Johnny G Spinning © Instructor Manual, (Copyright 1995).

(Continued)

*Primary Examiner*—Jerome Donnelly
*Assistant Examiner*—Tam Nguyen
(74) *Attorney, Agent, or Firm*—Dorsey & Whitney LLP

(57) ABSTRACT

A unique structure for an indoor exercise bike that provides strength in its design, as well as the flexibility to create an aesthetically appealing frame structure. The monocoque frame design, including two symmetrical halves joined together, forms a very strong, light shell that can take on a variety of shapes and sizes. The seat structure, handlebar structure, drive train and support platforms are all able to be readily attached to the primary frame structure to provide an exercise bicycle that is sturdy, easy to manufacture, and light enough to easily move when necessary.

26 Claims, 11 Drawing Sheets

U.S. PATENT DOCUMENTS

| | | | | |
|---|---|---|---|---|
| D53,150 | S | | 4/1919 | Harley |
| 1,336,774 | A | | 4/1920 | Cooper |
| 1,507,554 | A | | 9/1924 | Cooper |
| 1,571,013 | A | | 1/1926 | Ledig |
| 1,636,327 | A | | 7/1927 | Roe |
| 1,676,774 | A | | 7/1928 | Cronk |
| 1,820,372 | A | | 8/1931 | Blomquist |
| 2,032,303 | A | | 2/1936 | Orgitano |
| 2,066,557 | A | | 1/1937 | Cox |
| 2,255,864 | A | | 9/1941 | Stephens |
| 2,261,355 | A | | 11/1941 | Flynn |
| 2,301,362 | A | | 11/1942 | Brown et al. |
| 2,320,489 | A | | 6/1943 | Turner et al. |
| 2,382,841 | A | | 8/1945 | Alexander |
| 2,446,363 | A | | 8/1948 | Daum |
| 2,453,771 | A | | 11/1948 | White et al. |
| 2,510,973 | A | | 6/1950 | Guillemin, Jr. |
| 2,565,348 | A | | 8/1951 | Brockman et al. |
| 2,603,486 | A | | 7/1952 | Hughes |
| 2,616,416 | A | | 11/1952 | Gillmeier |
| 2,630,967 | A | | 3/1953 | Swanson et al. |
| 2,641,249 | A | | 6/1953 | Brockman |
| 2,680,967 | A | | 6/1954 | Newman |
| 2,758,532 | A | | 8/1956 | Awe |
| 2,784,591 | A | | 3/1957 | Shoor |
| 2,788,211 | A | | 4/1957 | Ivanoff |
| 2,825,563 | A | | 3/1958 | Lawton |
| 2,826,135 | A | | 3/1958 | Benzick |
| 2,866,358 | A | | 12/1958 | Duffy |
| 2,872,191 | A | | 2/1959 | Gallo, Sr. |
| 3,062,204 | A | | 11/1962 | Stefano |
| 3,112,108 | A | | 11/1963 | Hanke |
| 3,216,722 | A | | 11/1965 | Odom |
| 3,233,916 | A | | 2/1966 | Bowden |
| 3,275,339 | A | | 9/1966 | Mennesson |
| 3,283,997 | A | | 11/1966 | Bambenek et al. |
| 3,382,971 | A | | 5/1968 | Johnson |
| 3,432,164 | A | | 3/1969 | Deeks |
| 3,494,616 | A | | 2/1970 | Parsons |
| 3,495,475 | A | | 2/1970 | Rumsey |
| 3,511,097 | A | | 5/1970 | Corwin |
| D218,338 | S | | 8/1970 | Dimick et al. |
| 3,526,042 | A | | 9/1970 | Nelson |
| 3,550,523 | A | | 12/1970 | Segal |
| D220,024 | S | | 2/1971 | Fujiyoshi et al. |
| 3,578,800 | A | | 5/1971 | DeNepi |
| 3,581,663 | A | | 6/1971 | Lohmann |
| 3,596,921 | A | | 8/1971 | Bruckl |
| 3,603,609 | A | | 9/1971 | Hott |
| 3,623,582 | A | | 11/1971 | Giger et al. |
| 3,643,943 | A | | 2/1972 | Erwin, Jr. et al. |
| 3,664,027 | A | | 5/1972 | Fritz et al. |
| D225,070 | S | | 11/1972 | Proctor |
| 3,708,937 | A | * | 1/1973 | Sterner ..... 52/118 |
| 3,712,613 | A | | 1/1973 | Feather et al. |
| 3,751,033 | A | | 8/1973 | Rosenthal |
| 3,758,111 | A | | 9/1973 | Agamian |
| 3,767,195 | A | | 10/1973 | Dimick |
| D229,077 | S | | 11/1973 | Scalingi et al. |
| 3,784,194 | A | | 1/1974 | Perrine |
| 3,809,402 | A | | 5/1974 | Haines et al. |
| 3,822,599 | A | | 7/1974 | Brentham |
| 3,833,216 | A | | 9/1974 | Philbin |
| D233,160 | S | | 10/1974 | Jouk |
| 3,845,756 | A | | 11/1974 | Olsson |
| 3,848,467 | A | | 11/1974 | Flavell |
| 3,854,561 | A | | 12/1974 | Conde |
| 3,861,715 | A | | 1/1975 | Mendoza |
| D234,305 | S | | 2/1975 | Woods et al. |
| 3,869,121 | A | | 3/1975 | Flavell |
| 3,870,127 | A | | 3/1975 | Wilson et al. |
| 3,882,971 | A | | 5/1975 | Peckham, Jr. |
| 3,929,209 | A | | 12/1975 | Peckham, Jr. |
| 3,939,932 | A | | 2/1976 | Rosen |
| 3,940,128 | A | | 2/1976 | Ragone |
| 3,966,201 | A | | 6/1976 | Mester |
| 3,979,113 | A | | 9/1976 | Uhl et al. |
| 3,995,491 | A | | 12/1976 | Wolfla, II |
| D243,028 | S | | 1/1977 | Proctor |
| D243,165 | S | | 1/1977 | Wheeler |
| 4,003,168 | A | * | 1/1977 | Brady ..... 52/118 |
| 4,007,927 | A | | 2/1977 | Proctor |
| 4,009,769 | A | | 3/1977 | Nagatomo |
| 4,037,989 | A | | 7/1977 | Huther |
| RE29,404 | E | | 9/1977 | Blevens |
| 4,053,173 | A | | 10/1977 | Chase, Sr. |
| 4,060,239 | A | | 11/1977 | Pfleiderer et al. |
| 4,082,264 | A | | 4/1978 | Santos |
| 4,108,462 | A | | 8/1978 | Martin |
| 4,112,928 | A | | 9/1978 | Putsch |
| 4,140,312 | A | | 2/1979 | Buchmann |
| 4,150,851 | A | | 4/1979 | Cienfuegos |
| D251,747 | S | | 5/1979 | Valentine et al. |
| 4,184,678 | A | | 1/1980 | Flavell et al. |
| 4,188,030 | A | | 2/1980 | Hooper |
| D254,679 | S | | 4/1980 | Gustafsson |
| 4,220,232 | A | | 9/1980 | Fey et al. |
| D257,515 | S | | 11/1980 | Faux |
| 4,244,021 | A | | 1/1981 | Chiles, III |
| 4,261,562 | A | | 4/1981 | Flavell |
| 4,266,794 | A | | 5/1981 | Bals |
| 4,278,095 | A | | 7/1981 | Lapeyre |
| 4,285,515 | A | | 8/1981 | Gezari |
| 4,286,696 | A | | 9/1981 | Szymski et al. |
| 4,286,701 | A | | 9/1981 | MacDonald |
| 4,289,309 | A | | 9/1981 | Hoffmann |
| 4,291,787 | A | | 9/1981 | Brentham |
| 4,291,872 | A | | 9/1981 | Brilando et al. |
| 4,298,893 | A | | 11/1981 | Holmes |
| D262,302 | S | | 12/1981 | Disbrow et al. |
| 4,313,602 | A | | 2/1982 | Sullivan |
| 4,338,798 | A | | 7/1982 | Gilman |
| 4,340,125 | A | | 7/1982 | Watanabe et al. |
| 4,354,676 | A | | 10/1982 | Ariel |
| 4,355,958 | A | | 10/1982 | Cornick |
| 4,358,105 | A | | 11/1982 | Sweeney, Jr. |
| 4,371,185 | A | | 2/1983 | Bals |
| 4,372,551 | A | | 2/1983 | Yurdin |
| 4,379,566 | A | | 4/1983 | Titcomb |
| 4,408,613 | A | | 10/1983 | Relyea |
| 4,436,097 | A | | 3/1984 | Cunningham |
| 4,438,921 | A | | 3/1984 | Szymski |
| 4,441,705 | A | | 4/1984 | Brown |
| D273,882 | S | | 5/1984 | Bryne |
| 4,452,445 | A | | 6/1984 | Czekes |
| 4,456,276 | A | | 6/1984 | Bortolin |
| D275,589 | S | | 9/1984 | Gustafsson |
| 4,493,485 | A | | 1/1985 | Jones |
| 4,500,103 | A | | 2/1985 | Klein |
| 4,509,742 | A | | 4/1985 | Cones |
| 4,513,986 | A | | 4/1985 | Trimble |
| 4,519,603 | A | | 5/1985 | Decloux |
| D279,206 | S | | 6/1985 | Smith et al. |
| D280,117 | S | | 8/1985 | Collins |
| D280,118 | S | | 8/1985 | Collins |
| 4,533,136 | A | | 8/1985 | Smith et al. |
| 4,537,396 | A | | 8/1985 | Hooper |
| 4,542,897 | A | | 9/1985 | Melton et al. |
| 4,550,927 | A | | 11/1985 | Resele |
| 4,555,109 | A | | 11/1985 | Hartmann |
| 4,556,216 | A | | 12/1985 | Pitkanen |
| 4,561,318 | A | | 12/1985 | Schirrmacher |
| 4,566,692 | A | | 1/1986 | Brentham |
| 4,569,518 | A | | 2/1986 | Fulks |

4,571,682 A 2/1986 Silverman et al.
4,577,860 A 3/1986 Matias
D283,431 S 4/1986 Gustafsson
4,587,960 A 5/1986 Schotten
4,589,656 A 5/1986 Baldwin
D284,596 S 7/1986 McNeil
4,603,856 A 8/1986 Fiore
D285,816 S 9/1986 Berntsson
D285,953 S 9/1986 Gustafsson
4,613,146 A 9/1986 Sharp et al.
4,632,386 A 12/1986 Beech
4,636,001 A 1/1987 Weyenberg
4,642,769 A 2/1987 Petrofsky
4,645,472 A 2/1987 Heidenreich
4,647,036 A 3/1987 Huszczuk
4,657,244 A 4/1987 Ross
4,660,828 A 4/1987 Weiss
D289,669 S 5/1987 Kasuba et al.
D289,670 S 5/1987 Kasuba et al.
D289,782 S 5/1987 Szymski et al.
4,671,396 A 6/1987 Kotamaki
4,673,177 A 6/1987 Szymski
D291,462 S 8/1987 Aalto
D291,713 S 9/1987 Kiiski
4,693,468 A 9/1987 Kurlytis et al.
D292,225 S 10/1987 Breger
D292,304 S 10/1987 Ostrom
4,705,269 A 11/1987 DeBoer et al.
4,712,789 A 12/1987 Brilando
4,712,790 A 12/1987 Szymski
4,743,011 A 5/1988 Coffey
D296,457 S 6/1988 Anitua
4,752,066 A 6/1988 Housayama
4,757,988 A 7/1988 Szymski
4,762,317 A 8/1988 Camfield et al.
4,768,777 A 9/1988 Yang
4,772,069 A 9/1988 Szymski
4,775,145 A 10/1988 Tsuyama
4,786,049 A 11/1988 Lautenschlager
4,790,528 A 12/1988 Nakao et al.
D299,504 S 1/1989 Hong et al.
4,800,310 A 1/1989 Nakao et al.
D299,732 S 2/1989 Gustafsson
4,822,032 A 4/1989 Whitmore et al.
4,824,102 A 4/1989 Lo
4,826,150 A 5/1989 Minoura
4,844,451 A 7/1989 Bersonnet et al.
4,878,397 A 11/1989 Lennon
4,880,225 A 11/1989 Lucas et al.
4,902,001 A 2/1990 Balbo
4,902,002 A 2/1990 Huang
D306,626 S 3/1990 Szymski et al.
4,915,374 A 4/1990 Watkins
4,915,375 A 4/1990 Ginsburg
D307,614 S 5/1990 Bingham et al.
D307,615 S 5/1990 Bingham et al.
D307,782 S 5/1990 Birrell et al.
4,923,193 A 5/1990 Pitzen et al.
4,932,650 A 6/1990 Bingham et al.
4,934,688 A 6/1990 Lo
4,936,570 A 6/1990 Szymski et al.
D309,167 S 7/1990 Griffin
D309,485 S 7/1990 Bingham et al.
D310,253 S 8/1990 Bersonnet et al.
4,951,937 A 8/1990 Hoffenberg et al.
4,955,599 A 9/1990 Bersonnet et al.
4,961,570 A 10/1990 Chang
4,962,925 A 10/1990 Chang
4,971,316 A 11/1990 Dalebout et al.
D313,055 S 12/1990 Watterson
4,976,424 A 12/1990 Sargeant et al.
4,981,294 A 1/1991 Dalebout et al.
5,000,444 A 3/1991 Dalebout et al.
5,000,469 A 3/1991 Smith
5,014,980 A 5/1991 Bersonnet et al.
5,016,870 A 5/1991 Bulloch et al.
D318,086 S 7/1991 Bingham et al.
5,031,912 A 7/1991 Vaughn et al.
5,044,627 A 9/1991 Huang
5,046,723 A 9/1991 Szymski et al.
5,067,710 A 11/1991 Watterson et al.
D323,805 S 2/1992 Giard, Jr.
D323,863 S 2/1992 Watterson
5,094,124 A 3/1992 Stonehouse
5,114,391 A 5/1992 Pitzen et al.
5,125,648 A 6/1992 Olschansky et al.
5,145,477 A 9/1992 Han
5,145,479 A 9/1992 Olschansky et al.
5,149,312 A 9/1992 Croft et al.
5,178,593 A 1/1993 Roberts
5,186,697 A 2/1993 Rennex
D334,042 S 3/1993 Wang
5,203,826 A 4/1993 Dalebout
5,211,613 A 5/1993 Friesl
D337,748 S 7/1993 Adams
5,232,422 A 8/1993 Bishop, Jr.
5,247,853 A 9/1993 Dalebout
RE34,478 E 12/1993 Dalebout et al.
5,269,736 A 12/1993 Roberts
5,279,529 A 1/1994 Eschenbach
5,284,462 A 2/1994 Olschansky et al.
5,295,928 A 3/1994 Rennex
D346,145 S 4/1994 Jeshurun et al.
5,310,392 A 5/1994 Lo
5,319,994 A 6/1994 Miller
5,319,995 A 6/1994 Huang
5,330,402 A 7/1994 Johnson
5,336,147 A 8/1994 Sweeney, III
5,342,262 A 8/1994 Hansen
5,351,980 A 10/1994 Huang
D353,422 S 12/1994 Bostic et al.
D357,953 S 5/1995 Warehime et al.
5,423,728 A 6/1995 Goldberg
5,451,071 A 9/1995 Pong et al.
5,464,240 A 11/1995 Robinson et al.
5,472,396 A 12/1995 Brazaitis
D368,678 S 4/1996 Wilcox et al.
D372,284 S 7/1996 Wang et al.
5,533,953 A 7/1996 Lui et al.
5,569,128 A 10/1996 Dalebout
5,580,337 A 12/1996 Habing et al.
D380,024 S 6/1997 Novak et al.
D380,796 S * 7/1997 Wang et al. ..... D21/667
D382,924 S 8/1997 Wu
D382,925 S 8/1997 Wu
5,660,085 A 8/1997 Tamplin
D385,228 S 10/1997 Thompson et al.
5,685,553 A 11/1997 Wilcox et al.
5,722,916 A 3/1998 Goldberg
5,758,548 A 6/1998 Smith
5,772,916 A * 6/1998 Jamil et al. ..... 252/301.4 R
5,816,372 A 10/1998 Carlson et al.
5,833,575 A 11/1998 Holslag
5,836,856 A 11/1998 Mattoo et al.
5,857,943 A 1/1999 Murray
5,873,589 A 2/1999 Hallett
D407,767 S 4/1999 Chang
5,904,638 A 5/1999 Habing et al.
5,928,115 A 7/1999 Arroyo, Jr.
5,934,631 A * 8/1999 Becker et al. ..... 248/200.1
5,957,425 A * 9/1999 Conway et al. ..... 248/548
D415,083 S 10/1999 DeRoche
5,961,424 A 10/1999 Warner et al.
5,996,145 A * 12/1999 Taylor ..... 5/200.1
6,001,046 A 12/1999 Chang
6,146,313 A 11/2000 Whan-Tong et al.

| | | | | |
|---|---|---|---|---|
| 6,155,958 | A | 12/2000 | Goldberg | |
| 6,233,898 | B1 * | 5/2001 | Burlando | 52/736.3 |
| 6,264,878 | B1 | 7/2001 | Busby | |
| 6,383,121 | B1 | 5/2002 | Galasso et al. | |
| D460,133 | S | 7/2002 | Baker | |
| D460,794 | S | 7/2002 | Baker | |
| 6,413,191 | B1 | 7/2002 | Harris et al. | |
| D473,273 | S | 4/2003 | Crawford et al. | |
| 6,551,226 | B1 * | 4/2003 | Webber et al. | 482/148 |
| D474,252 | S | 5/2003 | Lull et al. | |
| 6,557,679 | B1 | 5/2003 | Warner et al. | |
| 6,561,952 | B2 | 5/2003 | Wu | |
| 6,564,673 | B1 | 5/2003 | Kilmer | |
| 6,612,600 | B2 | 9/2003 | Devitt et al. | |
| 6,612,970 | B2 * | 9/2003 | Forcillo | 482/57 |
| 6,641,507 | B1 | 11/2003 | Warner et al. | |
| 6,669,603 | B1 | 12/2003 | Forcillo | |
| 6,695,581 | B2 | 2/2004 | Wasson et al. | |
| 6,817,968 | B2 | 11/2004 | Galbraith et al. | |
| 6,901,879 | B2 * | 6/2005 | Burlando | 116/63 R |
| 2002/0077221 | A1 | 6/2002 | Dalebout et al. | |
| 2002/0151414 | A1 | 10/2002 | Baker | |
| 2002/0155929 | A1 | 10/2002 | Lull et al. | |
| 2003/0171191 | A1 | 9/2003 | Crawford et al. | |
| 2004/0248702 | A1 | 12/2004 | Baker | |

FOREIGN PATENT DOCUMENTS

| | | | |
|---|---|---|---|
| AU | 132504 | T | 5/1949 |
| CA | 994823 | | 8/1976 |
| CA | 1256139 | | 6/1989 |
| DE | 517774 | | 2/1931 |
| DE | 1961488 | | 7/1970 |
| DE | 2436594 | | 2/1976 |
| FR | 328506 | | 7/1903 |
| FR | 89009 | E | 4/1967 |
| FR | 89347 | E | 6/1967 |
| FR | 2003598 | | 11/1969 |
| FR | 2108579 | | 5/1972 |
| FR | 2500311 | | 8/1982 |
| GB | 4221 | | 2/1902 |
| GB | 300943 | | 11/1928 |
| GB | 1194046 | | 6/1970 |
| GB | 1281731 | | 7/1972 |
| GB | 1395908 | | 5/1975 |
| GB | 1469363 | | 4/1977 |
| GB | 2175812 | | 12/1986 |
| TW | 304432 | | 5/1997 |
| TW | 503751 | | 9/2002 |

OTHER PUBLICATIONS

Catalog: *Schwinn Fitness Equipment a change of shape,* available as early as 1995.

Advertisement: aerobika; Giugiaro Tresbispin "SAFETY" Apr. 23, 1998.

Brochure: Nowadays ApS; *Spinning Total Conditioning for the Body and the Soul;* date unknown.

Brochure: Schwinn Cycling & Fitness Inc., *Johnny G. Spinner, by Schwinn, GO FAST standing still,* 1995, 4 pages.

Catalog: *Schwinn® Fitness Equipment,* available as early as1985.

Catalog: *Schwinn® Fitness Catalog,* available as early as 1987.

Cartalog: *Schwinn '88 Lightweight Bicycles,* available as early as 1988.

Catalog: *1990 Schwinn Full-Line Fitness Catalog,* 1990.

Catalog: *Schwinn Fitness,* available as early as 1991.

Catalog: *The 1993 Schwinn Fitness Line,* available as early as 1993.

Catalog: *93 New Bikes, New Thinking,* available as early as 1993.

Catalog: *Schwinn® Fitness, Harness the Force of Nature and You Possess the Strength of Confidence* brochure 30 pages, 1996-1997.

Catalog: *Discover the Power Inside™, Schwinn 1995 fitness equipment,* available as early as 1995.

Catalog: *LeMond™ RevMaster™,* available as early as 2000.

Catalog: *Schwinn Fitness Equipment,* date unknown.

Picture: Reebok Studio Cycle; date unknown.

* cited by examiner

EXERCISE DEVICE TUBING

CROSS-REFERENCE TO RELATED APPLICATION

This application is a divisional of U.S. application Ser. No. 10/051,602, filed on Jan. 17, 2002, which is a non-provisional application claiming priority to U.S. Provisional Patent Application No. 60/262,768 entitled "Exercise Bicycle Frame" filed on Jan. 19, 2001, which is hereby incorporated by reference in its entirety.

FIELD OF THE INVENTION

The present invention involves an exercise bicycle and various aspects of the exercise bicycle.

BACKGROUND

One of the most enduring types of exercise equipment is the exercise bicycle. As with other exercise equipment, the exercise bicycle and its use are continually evolving. Early exercise bicycles were primarily designed for daily in home use and adapted to provide the user with a riding experience similar to riding a bicycle in a seated position. These early exercise bicycles extensively used cyclindrical tubing for nearly all components of the frame. In many examples, early exercise bicycles include a pair of pedals to drive a single front wheel. To provide resistance, early exercise bicycles and some modern exercise bicycles were equipped with a brake pad assembly operably connected with a bicycle type front wheel so that a rider can increase or decrease the pedaling resistance by tightening or loosening the brake pad engagement with the rim of the front wheel.

As exercise bicycles became increasingly popular in health clubs, the need for greater durability than is provided by cylindrical tubing emerged as many riders used the exercise bicycle throughout the day and night. Moreover, whether in health clubs or at home, the use and features provided by exercise bicycles evolved as many riders sought to achieve an exercise bicycle riding experience more similar to actual riding, which often includes pedaling up-hill, standing to pedal, and the like. One point in the evolution of the exercise bicycle is the replacement or substitution of the standard bicycle front wheel with a flywheel. The addition of the flywheel, which is oftentimes quite heavy, provides the rider with a riding experience more similar to riding a bicycle because a spinning flywheel has inertia similar to the inertia of a rolling bicycle tire.

Another point in the evolution of the use of the exercise bicycle is in group riding programs at health clubs, where transition between various different types of riding is popular, such as riding at high revolutions per minute (RPM), low RPM, changing the resistance of the flywheel, standing up to pedal, leaning forward, and various combinations of these types of riding. This evolution of the use of the exercise bicycle also brought about more demand for sturdy and durable exercise bicycles.

To meet the need for sturdier exercise bicycles that would stand up to continuous use throughout the day, that would support a heavy rapidly rotating flywheel, and that would stand up to group type exercise programs, exercise bicycles began being designed with square or box-beam type tubing, which in some instances is more durable and sturdy than cylindrical tubing. One drawback of box-beam type tubing is that it provides little flexibility in designing an aesthetically pleasing exercise bicycle.

Another drawback of exercise bicycles made with box-beam type tubing is that they are heavy and difficult to move. In some health clubs and in many homes, space is limited and is oftentimes used for many different purposes. For example, a room in a health club may be used for aerobics one hour and then used by a group of people all riding exercise bicycles the next hour, which requires that the exercise bicycles be moved around within or in and out of the room.

In addition to demand for durable sturdy exercise bicycles, riders desire exercise bicycles that can be adapted to fit a particular riders size. To meet this need, exercise bicycles with adjustable seats, adjustable handlebars, and the like have been designed. In some conventional exercise bicycles, box beam type posts and tubes are used for the seat and the handlebar in adjustable configurations. Typically, box beam tubing has as a square or rectangular cross section and therefore has four walls, with about 90 degree angles between the walls. For example, a square seat tube will receive a square seat post with a seat in an adjustable configuration which allows the seat post to be set within the seat tube at a variety of different heights.

One drawback of using box beam tubing in adjustable handlebar assemblies and seat assemblies is that oftentimes no walls are positively engaged or only one wall of the tube will engage one wall of the post. To move within the tube, the post must fit within the tube relatively loosely. To fix the post within the tube at a particular position, such as adjusting the height of the seat post or the height of the handlebar stem, oftentimes a pin will be inserted through an aperture in the tube to engage a corresponding aperture in the post. In such an arrangement, the seat, the handlebar, or both will oftentimes have a fairly loose feeling and might wobble noticeably during riding. In some instances, an additional device might force the rear wall of the post against the rear wall of the tube resulting in one wall of the post engaging one wall of the tube. In such an arrangement, wobbling and the feeling of unsteadiness might be reduced, but oftentimes is not eliminated. Besides having a feeling of unsteadiness, such movement between the post and the tube can result in metal on metal squeaking and can also cause wear and tear on the components.

It is with this background in mind that the present invention was developed.

SUMMARY OF THE INVENTION

The present invention includes a unique structure for an indoor exercise bike that provides strength in its design, as well as the flexibility to create an aesthetically appealing frame structure. The monocoque frame design, including two symmetrical halves joined together, forms a very strong, light shell that can take on a variety of shapes and sizes. The seat structure, handlebar structure, drive train and support platforms are all able to be readily attached to the primary frame structure to provide an exercise bicycle that is sturdy, easy to manufacture, and light enough to easily move when necessary.

According to one present aspect of the invention, the instant invention includes a frame for an exercise bicycle for supporting a flywheel, a seat assembly, and a handlebar assembly, the frame including a monoframe having an upper front end, a lower front end, and a rear end, and a set of forks, wherein the upper front end is attached to the forks and the lower front end is in a fixed position relative to the forks to make a rigid structure.

According to a further aspect of the present invention, the monoframe is a hollow body defined by two panels rigidly attached together and defining a space therebetween.

According to another aspect of the present invention, the exercise bicycle frame includes a monocoque frame member defining a rear support, a top support extending generally forwardly and upwardly from the rear support, and a seat support extending generally upwardly from the rear support, the seat support between the rear support and the top support.

According to another aspect of the present invention, the seat assembly and the handlebar assembly both utilize nested trapezoidal tubing to provide secure adjustment of the handlebar assembly or the seat assembly with respect to the frame.

Other features, utilities, and advantages of various embodiments of the invention will be apparent from the following, more particular description of embodiments of the invention as illustrated in the accompanying drawings and set forth in the appended claims.

DESCRIPTION OF THE DRAWINGS

The detailed description will refer to the following drawings, wherein like numerals refer to like elements, and wherein.

DETAILED DESCRIPTION

Figure 1:
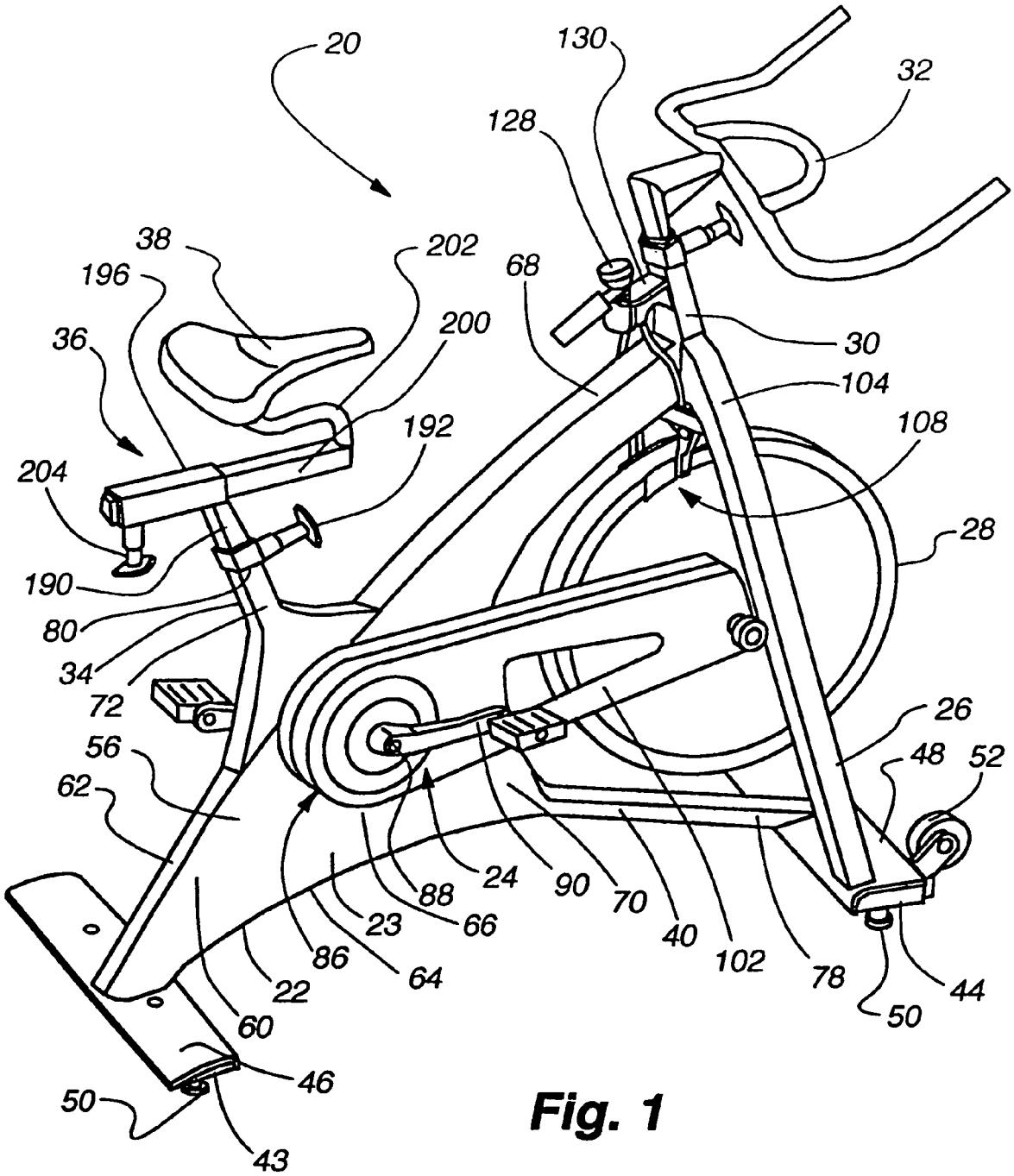
FIG. 1 is a perspective view of an exercise bicycle according to one embodiment of the invention.
Figure 2:
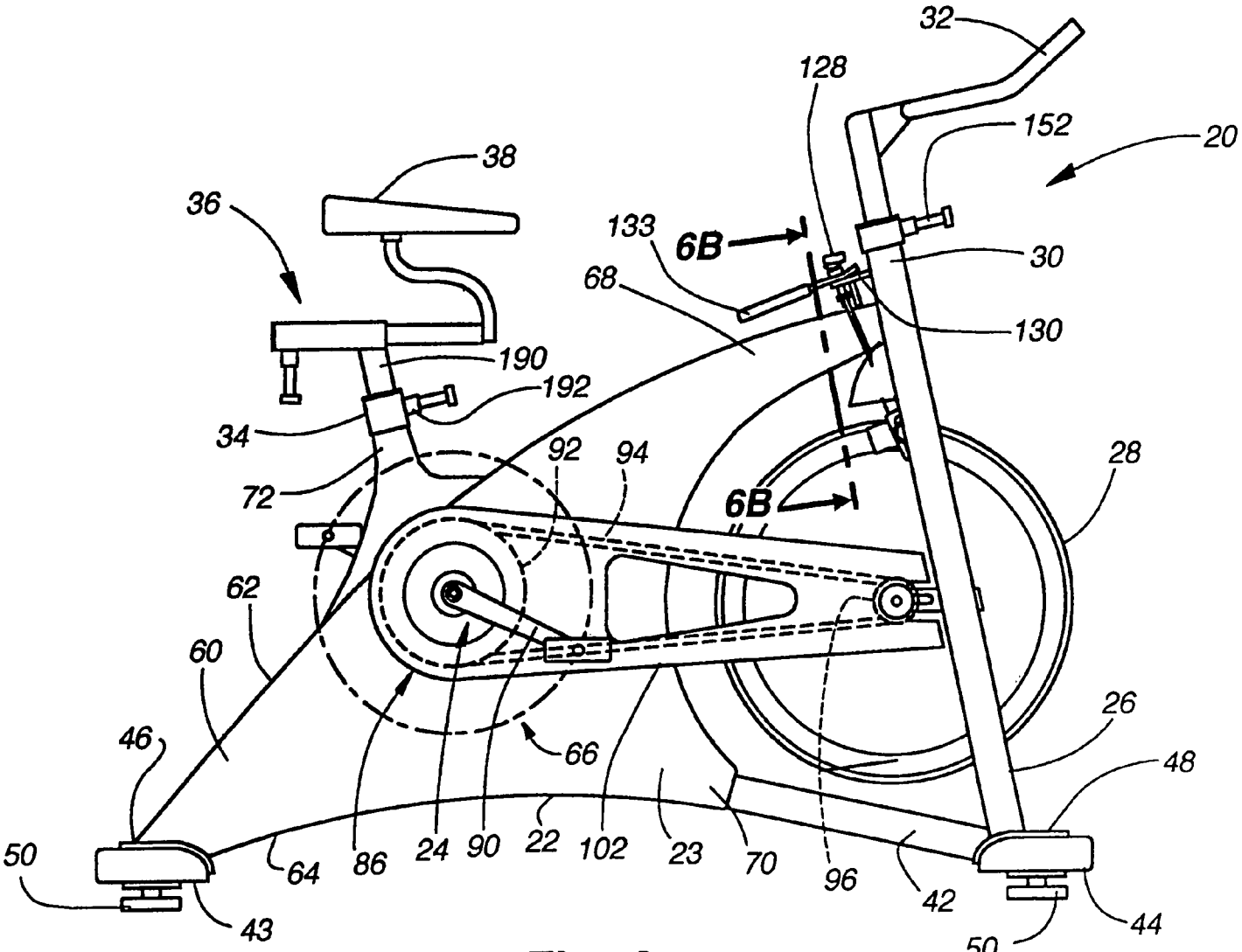
FIG. 2 is a side view of an exercise bicycle according to one embodiment of the invention.
Figure 3:
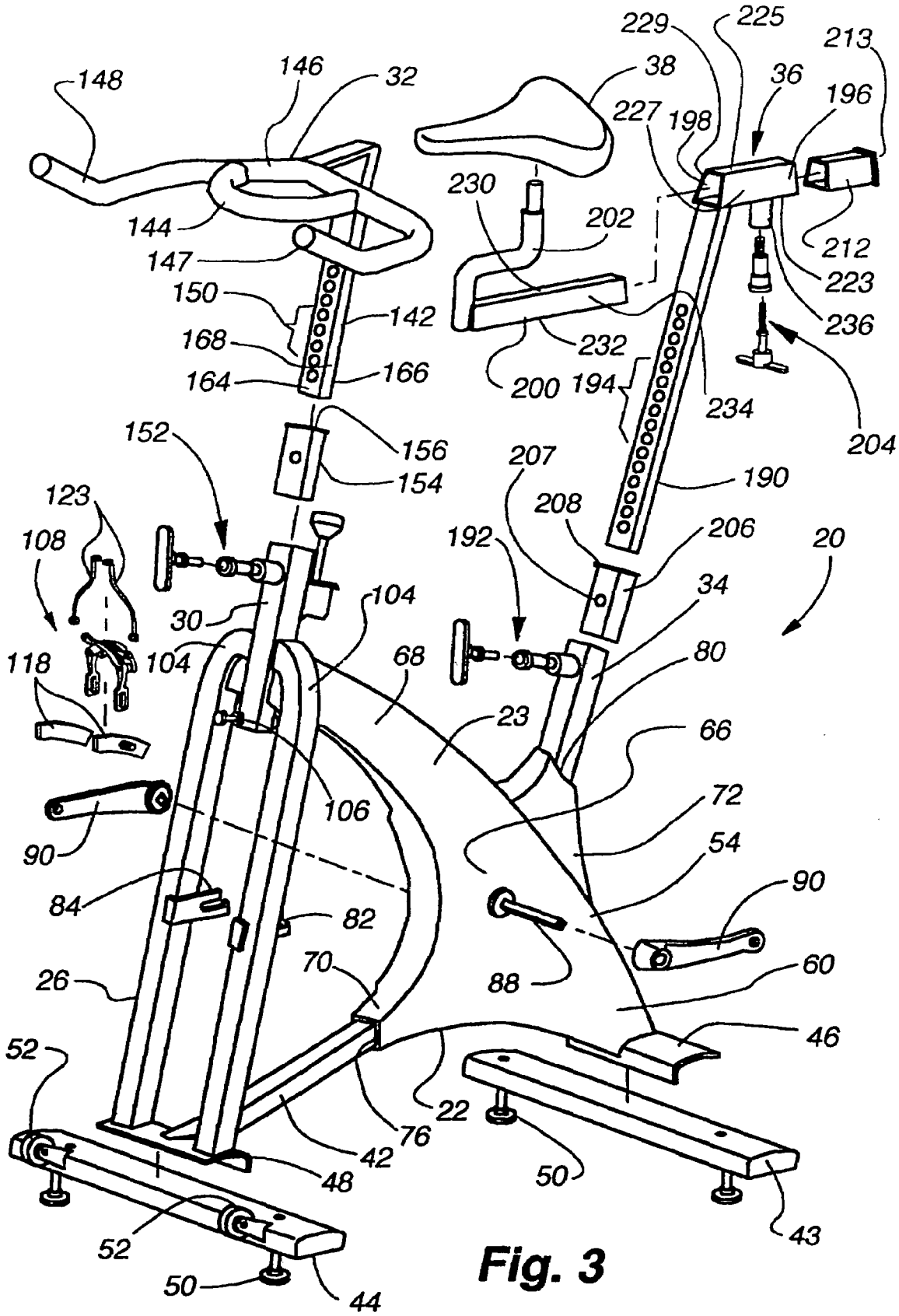
FIG. 3 is an exploded perspective view of the exercise bicycle illustrated in FIG. 2.

FIG. 1 is a perspective view of one embodiment of an exercise bicycle 20 according to the invention. The exercise bicycle includes a frame 22 with a monoframe structure 23 supporting a pedal assembly 24 (FIGS. 1, 2), a front fork 26 connected with the monoframe structure for supporting a flywheel 28, a head tube 30 projecting upwardly from the front fork 26 and adjustably supporting a handlebar assembly 32, and a seat tube 34 projecting upwardly from the monoframe structure and adjustably supporting a seat assembly 36 having a seat 38. For convenience, the terms "rear," "front," "right," and "left" will refer to the perspective of a user sitting on the seat 38 of the exercise bicycle and facing toward the handlebar assembly 32. FIG. 2 is a side view of another embodiment of an exercise bicycle according to the invention. The exercise bicycle illustrated in FIG. 1 has a bottom tube 40 that is an integral extension of the central monoframe structure while the exercise bicycle illustrated in FIG. 2 has a separate square bottom tube 42 that is secured to the monoframe structure. The bottom tube 42 structure is discussed in more detail below. The exercise bicycles illustrated in FIG. 1 and FIG. 2 are similar in all other respects. FIG. 3 is an exploded perspective view of the exercise bicycle illustrated in FIG. 2.

Generally speaking, a user operating the exercise bicycle will oftentimes first adjust the seat assembly 36 and the handlebar assembly 32. The seat 38 may be adjusted both vertically and horizontally and the handlebars may be adjusted vertically. Once the exercise bicycle is properly adjusted, the user will sit on the seat 38 and begin pedaling. Pedaling will cause the flywheel 28 to begin to rotate, and the harder the user pedals the faster the flywheel will rotate. The flywheel is fairly heavy, which makes it fairly strenuous to start the flywheel rotating, but once it is rotating it has inertia which helps keep the flywheel rotating.

Figure 4:
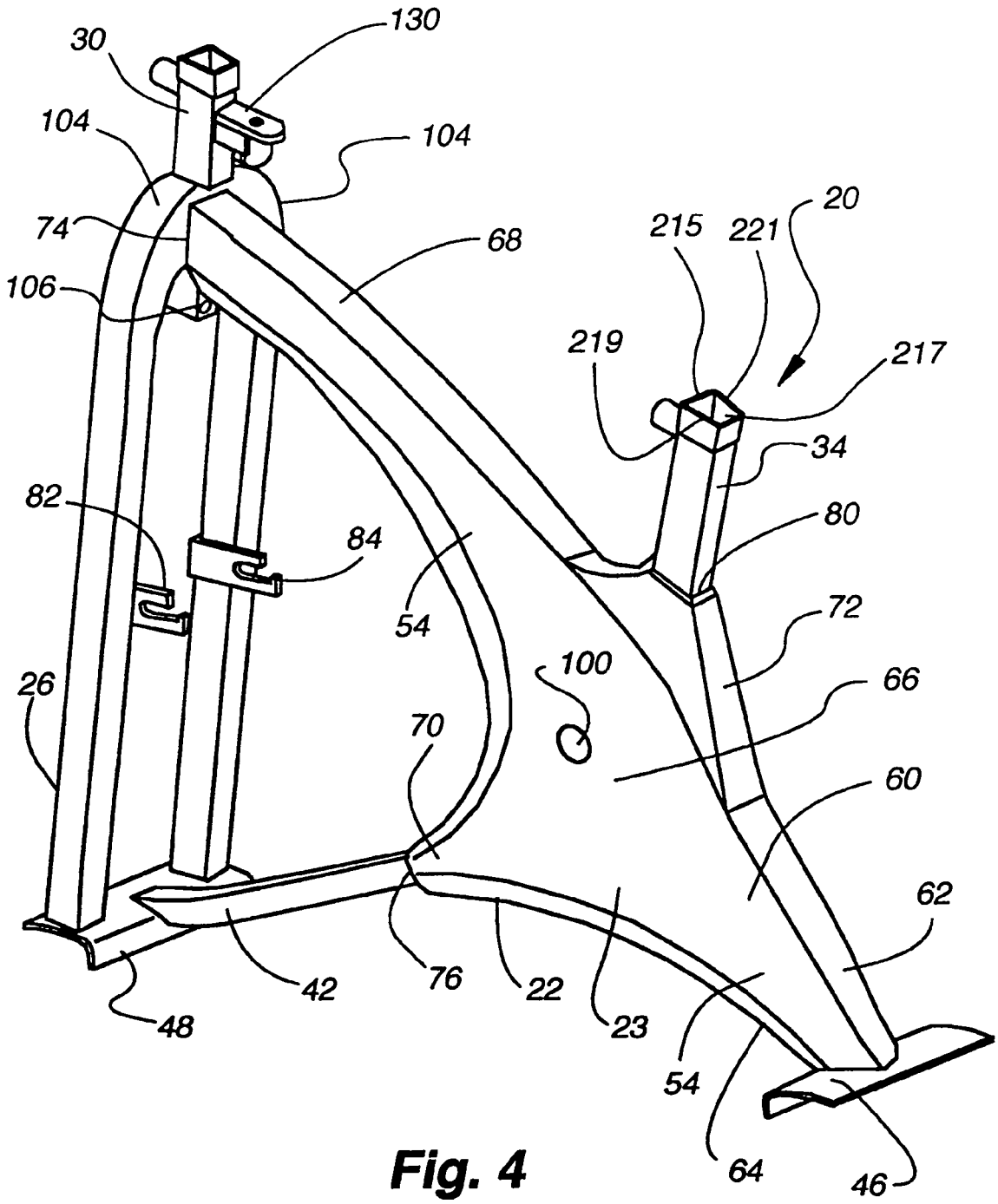
FIG. 4 is a perspective view of an exercise bicycle frame according to one embodiment of the invention.

FIG. 4 is a perspective view of one embodiment of the frame of the exercise bicycle illustrated in FIGS. 2 and 3. In FIG. 4, the frame is shown by itself, with various components of the exercise bicycle removed, such as the handlebar assembly, the pedal assembly, the seat assembly, and the flywheel. Referring to FIGS. 1–4, the frame 20 is supported on the floor or any other suitable surface at a rear base 43 and a front base 44. The rear base 43 and the front base 44 extend laterally with respect to the length of the exercise bicycle 20 to provide lateral support when side-to-side forces are applied to the exercise bicycle, such as when standing on the pedals and pedaling vigorously and when mounting or dismounting the exercise bicycle. In one example, a rear laterally extending partially curved plate 46 is connected with the rear portion of the monoframe structure 23 and is secured with the rear base 43, and a front laterally extending partially curved plate 48 is connected with the bottom of the front forks 26 and the front of the bottom tube 42 and is secured to the front base 44.

As best shown in FIG. 3, adjustable floor stands 50 extend downwardly from the bottom outside portions of the rear base 43 and the front base 44 to level the exercise bicycle 20 in the event the exercise bicycle is used on a sloped or uneven surface. In addition, one or more wheels 52 are connected with the front of the front base 44 to allow a user to conveniently move the exercise bicycle. In one example, a left and a right wheel are each rotabably supported on a corresponding left and right brackets that are connected proximate the left and right side of the base, respectively, and extend forwardly and somewhat upwardly from the front base. The bracket is oriented somewhat upwardly so that the exercise bicycle may be pivoted from the rear upwardly and forwardly to cause the wheels to move downwardly and engage the floor, from which position the exercise bicycle may be rolled along the floor to a different location. Alternatively, one wheel may be rotabably supported at the front of the front base rather than two wheels.

The central monoframe portion 23 of the frame 22, in one example, is made from a left side panel 54 and a right side panel 56 seam welded together. The monoframe structure provides a central support structure for the frame 22 that is sturdy and durable to withstand the rigors of use by many riders and yet also fairly light weight to provide easy maneuverability about a health club or a home. In addition, the shape of the monoframe structure may be configured into any number of aesthetically pleasing shapes, the frame examples illustrated herein being only discrete examples of such aesthetically pleasing shapes.

Figure 5A:
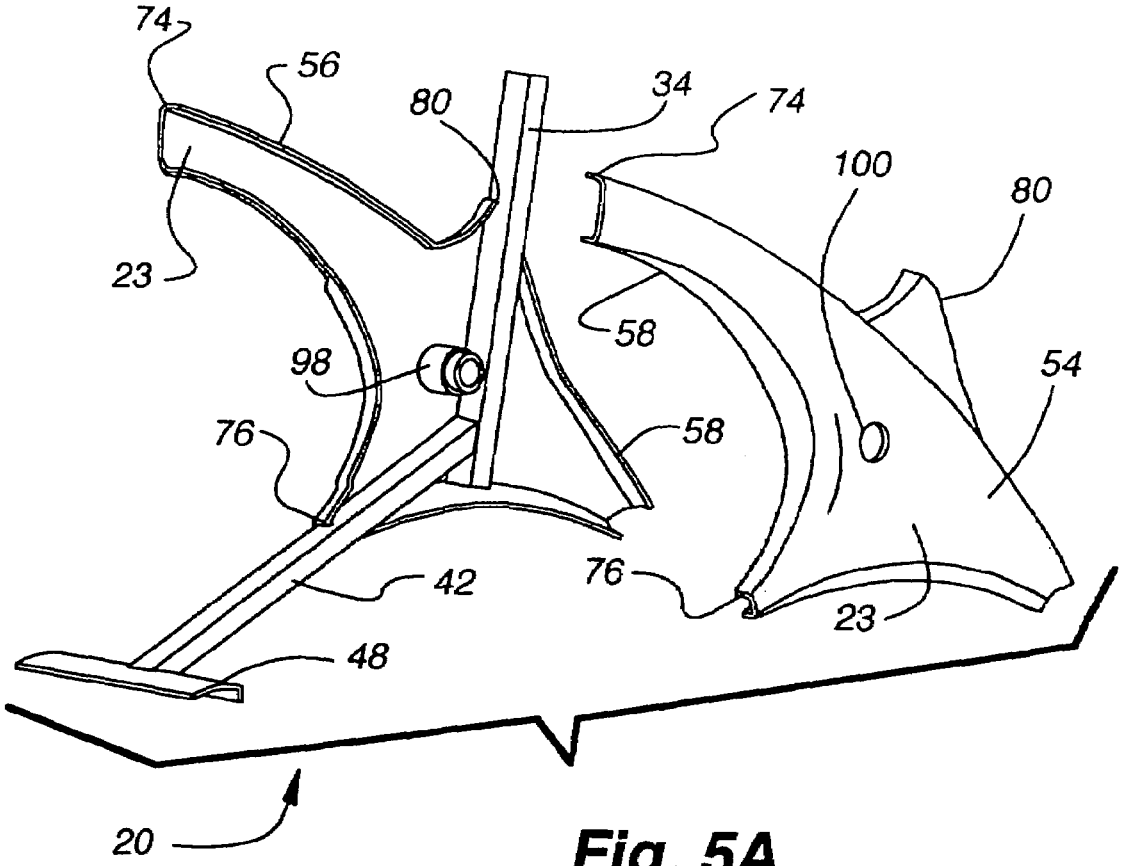
FIG. 5A is an exploded left-side perspective view of a monocoque frame member illustrating a left monocoque panel and a right monocoque panel according to one embodiment of the invention.
Figure 5B:
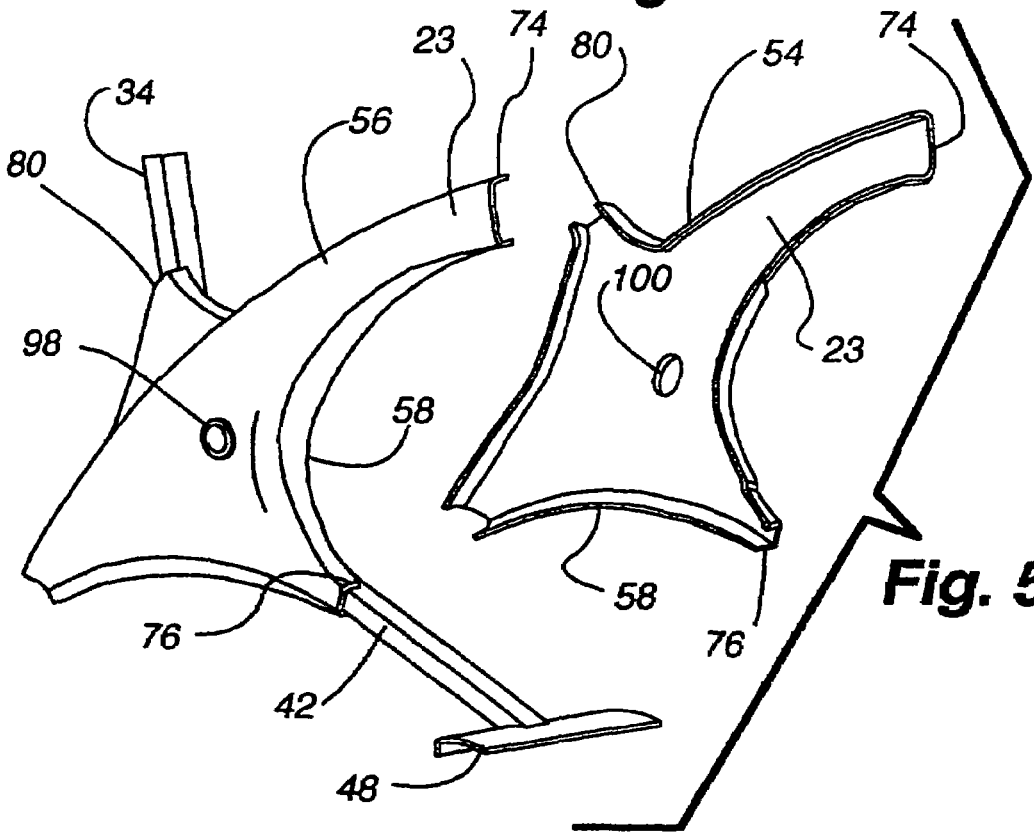
FIG. 5B is an exploded right-side perspective view of the monocoque frame member illustrated in FIG. 5A.

FIG. 5A is an exploded left-side perspective view of the monoframe structure illustrating the inner portion of the right side panel 56 and the outer portion of the left side panel 54. FIG. 5A also illustrates the welded connection between the bottom tube 42 and a seat post 34 within the monoframe structure according to one embodiment of the invention, which is discussed below. FIG. 5B is an exploded right-side perspective view of the monoframe structure illustrating the outside of the right side panel 56 and the inside of the left side panel 54. The seat tube 34 and the bottom tube 42 can be welded to the side panels along their length, or can just be attached to the side panels where the tubes extend out of the monoframe structure (such as by welding around the perimeter of the respective tube).

The two side panels 54 and 56 of the monoframe structure 23 are substantially mirror images of each other. The panels define corresponding peripheral edges 58 that mate together when the two panels 54 and 56 are engaged. In one example, the two side panels define a hollow space between the side panels. In one example, the mating peripheral edges 58 align with each other and can overlap or butt together as necessary to allow for a seam weld between the peripheral edges 58 to secure the panels 54 and 56 together. The seam weld extends along the entire length of the abutting peripheral edges and thus provides very high strength in the connection between the two side panels. The side panels may be secured together through other means besides a seam weld, such as a series of spot welds, a series of rivets, interlocking releasable tabs, and the like. In one embodiment, the side panels are made of stamped steal and are between 2.0 mm and 2.5 mm thick. The stamped steel, however, can be any suitable thickness depending on the loads that the exercise bicycle needs to withstand. In addition, the side panels may be made from any suitable material besides steel, such as an alloy, aluminum or plastic. If plastic or other polymer side panels are used, the side panels may be secured by a suitable adhesive, interlocking releasable tabs, sonic welding, and the like.

A forwardly widening rear support 60 is defined at the lower rear of the monoframe structure 23. In one example, the rear support 60 defines an upper curved (convex) wall 62, which is connected with the rear plate 46 and a lower curved (concave) wall 64, which is also connected with the rear plate 46. The rear support portion 60 of the monoframe 23 is defined entirely by corresponding portions of the left 54 and right 56 side panels.

From the rear support 60, the monoframe structure defines a forwardly sweeping aesthetically pleasing shape that widens into a central monoframe portion 66. The monoframe has a generally curved (convex) top surface and a generally curved (concave) bottom surface. An upper or top support structure 68 extends forwardly and upwardly from the upper forward portion of the central monoframe portion 66, a lower or bottom support structure 70 extends forwardly and downwardly from the lower front portion of the central monoframe portion 66, and a seat support structure 72 extends upwardly from the upper portion of the central monoframe 66 between the rear support 60 and the top support 68. In the embodiments of the invention discussed herein, the arcuate surfaces of the monoframe provide aesthetically pleasing lines of the frame generally. In addition, the smooth sweeping curves of the monoframe reduce stress risers and can be adjusted to provide any number of aesthetically pleasing shapes without impacting the strength of the monoframe structure.

The front of the top support structure 68 of the monoframe 23 is connected to the head tube 30 adjacent the top of the front forks 26. In the embodiment illustrated in FIGS. 1–4, the vertical dimension of the top support structure 68 generally narrows as it sweeps forwardly and upwardly from the central monoframe portion 66 to the head tube 30. The top support structure 68 defines an upper surface and a lower surface. The upper surface of the top support is generally curved (convex) along its length from rear to front between the central monoframe portion 66 and the front forks 26, while the lower surface of the top support is generally curved (concave) along its length from rear to front. The upper surface of the top support 68 maintains the continuity of the forwardly sweeping shape of the monoframe that begins at the rear support 60.

The top support 68, as best shown in FIGS. 5A and 5B, is defined by the attached side panels 54 and 56 of the monoframe 23 and requires no box-beam, cylindrical, or other type of tubing. The forward end of the top support 68 defines an aperture including a rim 74 defined by the combined side panels. The rim 74 at the front end of the top support 68 is attached with the rear wall of the head tube 30 by a seam weld between the rim 74 and the top support 78. This weld is a long "butt" joint and thus provides significant strength between the top tube and the front forks 26.

The bottom support structure 70 defines a narrowing or tapering shape extending forwardly and downwardly from the central monoframe structure 66. In one example, the bottom support structure 70 defines a top curved (convex) surface and a bottom curved (concave) surface. The top surface of the bottom support intersects with the lower surface of the top support in a continuous sweep that defines a forwardly extending concave front surface (C-shaped) of the central monoframe portion 66 adapted to cooperate with the flywheel 28 as discussed below. The bottom curved surface of the bottom support structure 70 maintains the continuity of the curved sweep of the monoframe that begins at the rear support 60. The curve along the top of the monoframe is convex upwardly. The curve along the bottom is concave downwardly, and the curve along the front is concave forwardly, thereby forming a general triangular body structure that provides excellent strength characteristics.

As shown in FIGS. 2–4, 5A and 5B, the upper surface and the lower surface of the bottom tube portion 70 of the monoframe converge to define a bottom tube aperture 76 having a rectangular shape. A bottom tube 42 defining a rectangular cross section extends forwardly and downwardly from the bottom tube opening 76 and is connected at its forward end with the front laterally extending plate 48, which is secured with the front base 44. The bottom tube 42 extends through the bottom tube aperture 76 and into the hollow space defined by the two side panels 54 and 56, in one example. If desired, the bottom tube 42 can be welded around its perimeter to the outside rim of the bottom tube aperture 76 to add further strength to the frame. In addition, the bottom tube 42 can be welded along its length to the inside of one of the side panels of the monoframe 23, such as the left panel or the right panel, to provide further support between the seat tube and monoframe. Besides complementing the appealing aesthetic quality of the flowing lines of the monoframe, the tapering shape of the bottom tube structure also facilitates welding the rim of the bottom tube opening 76 to the bottom tube 42 such as when automated welding equipment is used. The end of the bottom tube 42 inside the monoframe is attached to the bottom portion of the seat tube 34, such as by welding.

The bottom tube 42 is shown in FIGS. 2–5B as a separate tube extending from the bottom tube opening 76. The monoframe, however, may be configured to define an integrated bottom tube support that is part of the bottom tube structure and extends downwardly and forwardly from the bottom tube support structure 70, such as is shown in FIG. 1. In the embodiment of the invention with an integrated bottom tube 78, the bottom tube 78 is made entirely from the monoframe side panels 54 and 56, and does not include any square tubing, cylindrical tubing, or the like.

The seat support portion 72 of the monoframe structure 23 extends generally upwardly from the central monoframe structure 66. The seat support 72 is part of the monoframe structure and, in one example, is defined by two mating mirror image side portions of the monoframe structure, which are seam welded together. The seat tube portion includes a curved front wall and a curved rear wall. The front wall and the rear wall converge together to define a rectangular seat tube aperture 80 through which the seat tube 34 extends upwardly and somewhat rearwardly. In one example, the seat tube aperture 80 is trapezoidal and is adapted to cooperate with the seat tube 34, which is also trapezoidal. The trapezoidal nature of the seat tube 34 and other tubing is discussed in more detail below.

The seat tube 34 extends through the seat tube aperture 80 in the upper central portion of the monoframe 23 and into the hollow space defined by the two side panels 54 and 56, in one example. If desired, the seat tube 34 can be welded around its perimeter to the outside rim of the seat tube aperture 80 to add further strength to the frame. The seat support 72 defines flowing sweeping lines complementary to the other lines of the monoframe. The shape of the seat support 72 also facilitates seam welding the seat tube 34 to the rim of the seat tube opening 80. As with the bottom tube 42, the seat tube is illustrated herein as a separate tube extending upwardly from the central portion of the monoframe 66. The monoframe, however, may be configured to define an integrated seat tube that is part of the seat tube portion of the monoframe and that extends upwardly and somewhat rearwardly from the area of the seat support adjacent the seat tube aperture. The integrated seat tube is made from mirror image portion of the side panels, as shown in FIG. 1. As an integrated seat tube, no additional tubing is needed.

Referring to FIG. 5, an embodiment of the invention with the seat tube 34 connected to the bottom tube 42 within the hollow space defined by the two side panels 54 and 56 is shown. The bottom tube 42 is welded to the lower portion of the seat tube 34 to impart additional strength and rigidity to the frame 20. Alternatively or additionally, the seat tube 34 and bottom tube 42 may be welded to the inside of one of the side panels 54 and 56 of the monoframe, welded to the rim of the seat tube aperture 80 or the bottom tube aperture 76 respectively, or some combination of welds to secure the seat tube 34 and bottom tube 42 to the monoframe.

Typically, the bottom tube 42 and seat tube 34 are chromed or stainless steel and are dimensioned in any reasonable size to withstand the intended use of the exercise bicycle. The tubes can be rectangular, square, oval, cylindrical, and solid or hollow. In one example, the bottom tube 42 and the seat tube 34 are hollow, which makes the tubes lighter than a solid tube. In the event a polymer monoframe is used, then polymer tubing may also be used, which may be glued, sonic welded, or otherwise connected with the monoframe.

As best shown in FIGS. 2 and 4, at the front of the frame, the front fork 26 extends between the front support plate 48 and the forward portion of the top support 68. The front fork 26 includes a left fork leg and a right fork leg, each extending upwardly from the front support and defining a space in which the flywheel is located as shown in FIGS. 1 and 2. A left receiving bracket 82 and a right receiving bracket 84 are positioned on the inside surface of each of the fork legs for securing opposing ends of an axle of the flywheel 28. When positioned in the receiving brackets the flywheel 28 is located between the front fork legs. The portion of the flywheel 28 generally rearward of the axle occupies the space defined by the rearwardly extending curved face of the central monoframe 66 bordered by the lower surface of the top portion 68 and the upper surface of the bottom support 70. The flywheel 28 includes a flywheel sprocket circumferentially disposed about the axle on the right side of the flywheel and configured to receive a chain. In addition, the flywheel may include a freewheel clutch mechanism, such as is shown in U.S. Pat. No. 5,961,424 entitled "Free Wheel Clutch Mechanism for Bicycle Drive Train" and related patent application Ser. No. 09/803,630, filed Mar. 9, 2001 entitled "Free Wheel Clutch Mechanism for Bicycle Drive Train" which are both hereby incorporated by reference in their entirety. The freewheel clutch mechanism disengages the rotation of the flywheel from the rotation of the pedal assembly and drive train when the user impacts a force on the pedals contrary to the rotation of the flywheel, and that force is sufficient to overcome a break-free force of the free wheel clutch mechanism.

The drive train 86 includes an axle 88 having crank arms 90 extending transversely from each end of the axle, and a drive sprocket 92 circumferentially disposed about the right side of the drive axle. See FIGS. 1 and 2. The chain 94 is operably connected between the drive sprocket 92 and the flywheel sprocket 96. Referring to FIGS. 4 and 5A and 5B, a crank set bearing bracket 98 or bottom bracket is attached to a forward wall of the seat tube 34 just above the bottom tube 42. The bearing bracket 98 rotatably supports the drive train 86. The crank set bearing bracket 98 is positioned in the central monoframe portion 66 and extends between the two side panels 54 and 56 that make up the monoframe. Each panel of the monoframe defines an aperture 100 through which the opposing ends of the bearing bracket 98 extend and through which the drive train axle extends. The portion of the bottom bracket extending through the side panel apertures may be welded to the side panels to provide further structural support and rigidity to the frame. The crank arms 90 and the drive sprocket 92 are mounted on the portions of the drive axle that extend out of the monoframe structure.

Referring to FIGS. 1 and 3, the drive sprocket 92 is located on the right side of the monoframe and supports the chain 94 operably connected with the flywheel sprocket 96. In the embodiment shown herein, the drive sprocket 92 is larger than the flywheel sprocket 96 to allow the rider to develop a high revolution per minute (RPM) rate of the flywheel and thus create a high momentum while at the same time having less RPMs at the crank arms. In such a configuration, the rider is able to achieve an exceptionally vigorous workout similar to riding a bicycle at a fairly high rate of speed. The size of the drive sprocket and flywheel sprocket, however, may be configured in any way required to achieve a desired RPM rate at the flywheel or at the crank arms. In addition, a gearing structure with a plurality of sprockets of differing size may be connected with the drive axle or with the flywheel axle to achieve a desired work out. As shown in FIG. 1, a drive train shroud 102 may be provided to cover the drive sprocket, the chain, the flywheel sprocket and other drive train components so that unintentional contact with the drive train is reduced.

The top of each fork leg defines an inwardly extending curve 104 that abuts the side wall of the head tube 30. In the embodiment shown herein, the top support 68 is welded to the rear wall of the head tube 30, the left fork leg is welded to a left side wall of the head tube, and the right fork leg is welded to a right side wall of the head tube. The head tube 30 extends downwardly past the attachment with the fork legs and defines a dampening aperture 106 extending between the front wall and the rear wall for supporting a brake assembly.

Figure 6A:
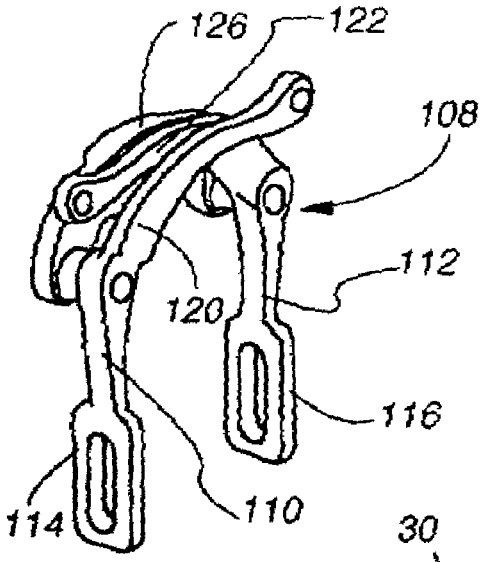
FIG. 6A is a perspective view of a brake assembly according to one embodiment of the invention.

FIG. 6A is a perspective view of a brake assembly 108 according to one embodiment of the invention. FIG. 6B is a rear view of the brake assembly 108 connected to the rear wall of the head tube taken along line 6B—6B of FIG. 2. Referring to FIGS. 3, 6A, and 6B, the brake assembly includes a left 110 and a right brake arm 112, each having a generally inverted L-shape with a downwardly extending arm 114 and 116, respectively, adapted to adjustably receive a brake pad 118 and a generally horizontal arm 120 and 122, respectively, adapted to receive a brake cable 123. The brake arms are configured so that the brake pads may engage the rim 124 of the flywheel 28. Adjacent the intersection of the downwardly extending arm and the generally horizontal arm, each brake arm is pivotally connected to a mounting bracket 126 that positions the pivots above and to either side of the flywheel.

Referring to FIG. 6B, an adjustment knob 128 is rotabably supported on a mounting bracket 130 connected with the head tube 30. The adjustment knob 128 includes a downwardly extending threaded post 132 adapted to engage a plate 134 supporting the brake cable 123 and defining a threaded aperture adapted to cooperate with the threaded post 132. Rotation of the knob 128 in a clockwise direction draws the plate 134 upwardly and accordingly draws the brake cable 123 upwardly, and rotating the knob 128 in a counter clockwise direction moves the plate 134 downwardly and hence relaxes the brake cable 123. Drawing the brake cable 123 upwardly causes the ends of the generally horizontal arms 120 and 122 connected with the brake cable 123 to move upwardly and thereby brings the brake pads 118 into engagement with the flywheel 28. The brake assembly also includes one or more springs biased so that relaxing of the brake cables causes the brake arms to move away from engagement with the flywheel 28.

Figure 6C:
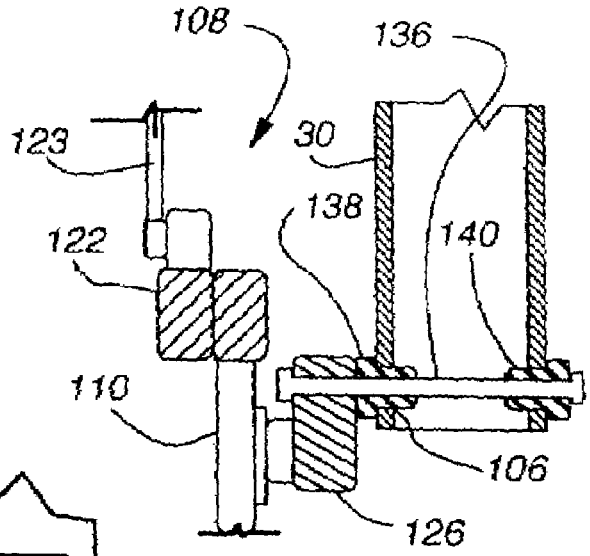
FIG. 6C is a section view taken along line 6C—6C of FIG. 6B illustrating a vibration dampening device according to one embodiment of the invention.
Figure 6B:
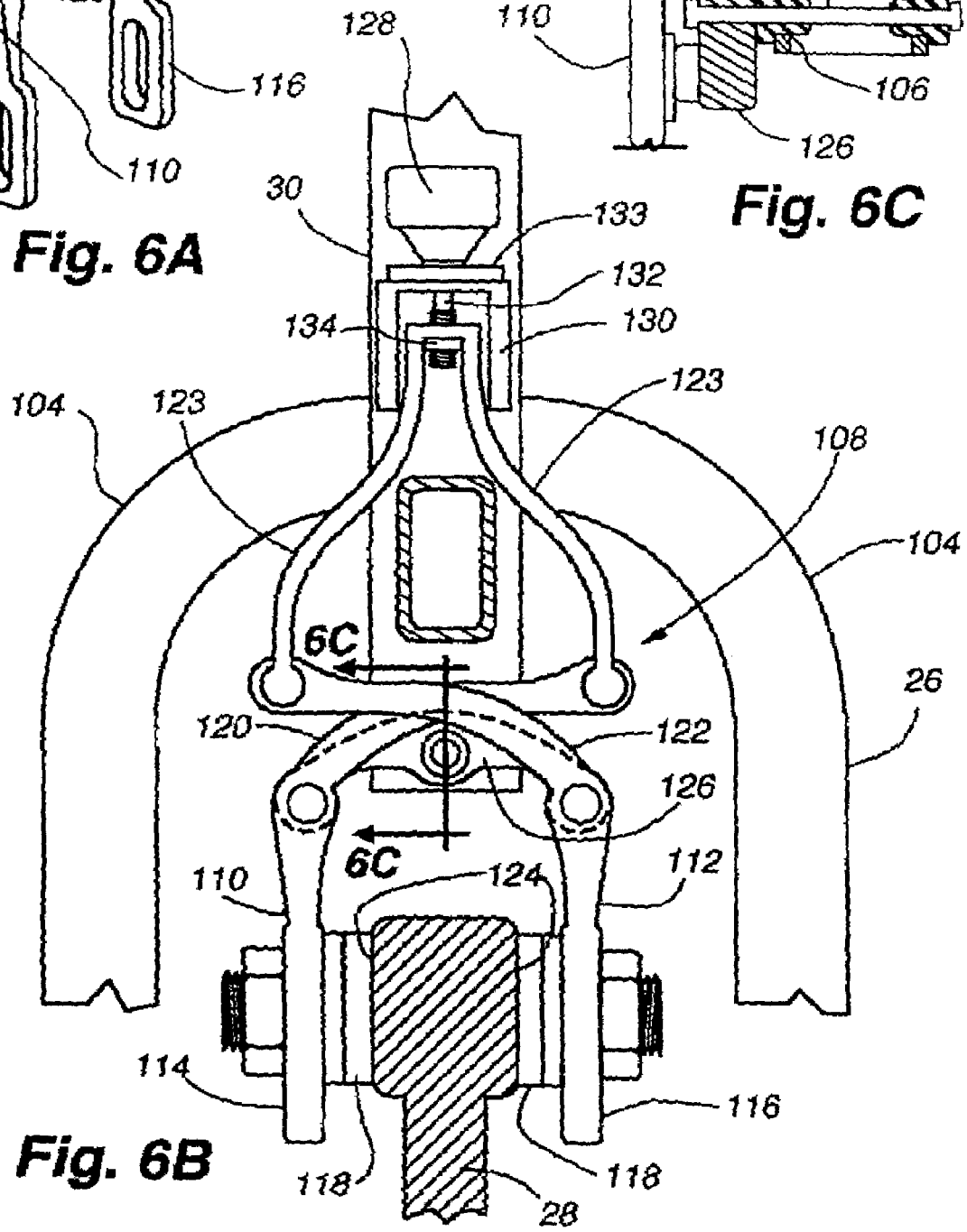
FIG. 6B is a view of the rear of the brake assembly taken along line 6B—6B of FIG. 2.

FIG. 6C is a section view taken along line 6C—6C of FIG. 6B illustrating a vibration dampening device used to connect the brake assembly with the frame. The vibration dampening device includes a rod 136 and a front grommet 138 and a rear grommet 140 for supporting the rod. The front and rear grommets are supported in the aperture 106 defined in the lower portion of the head tube 30. The rod 136 extends through both grommets and fixes the mounting bracket 126 to the head tube 30. The grommets are made of a resilient, rubber-like material. The vibration dampening device reduces translation of any vibrations from the flywheel to the frame of the exercise bicycle.

A lever 133 attaches to the rod 132 just below the knob and above the mounting bracket 130. The lever extends forwardly of the rod and forms a fulcrum (pivot point) at which point the lever is pivoted to lift the knob and apply the brake without having to turn the knob. This thus acts as a quick-stop brake.

Referring to FIG. 3, an exploded perspective view of a handlebar assembly 32 is shown according to one embodiment of the invention. The handlebar assembly includes a handlebar adjustably supported in the head tube 30 by a handlebar stem 142. The handlebar includes a ring 144 connected to a transverse bar 146. The handlebar also includes left 147 and right 148 prong grips extending forwardly from the transverse bar 146. The handlebars provide a variety of gripping positions for the user.

In one example, the handlebar stem 142 defines a trapezoidal cross section adapted to fit within a corresponding trapezoidal aperture defined by the head tube 30. The front of the handlebar stem defines a plurality of apertures 150 adapted to receive a pop pin 152, which is discussed in more detail below. An insert 154 may be fitted between the stem 142 and head tube 30 to reduce friction between the head tube 30 and the stem 142 when adjusting the handlebars 32 and to reduce any squeaking caused by metal on metal contact between the head tube 30 and handlebar stem 142 (without the insert) that might be caused when the stem is moved relative to the head tube. The insert 154 defines an upper flange 156 that engages the upper rim of the head tube. The insert 154 also defines a plurality of apertures slightly larger than the apertures in the handlebar stem, which apertures align with the apertures in the stem.

Figure 7A:
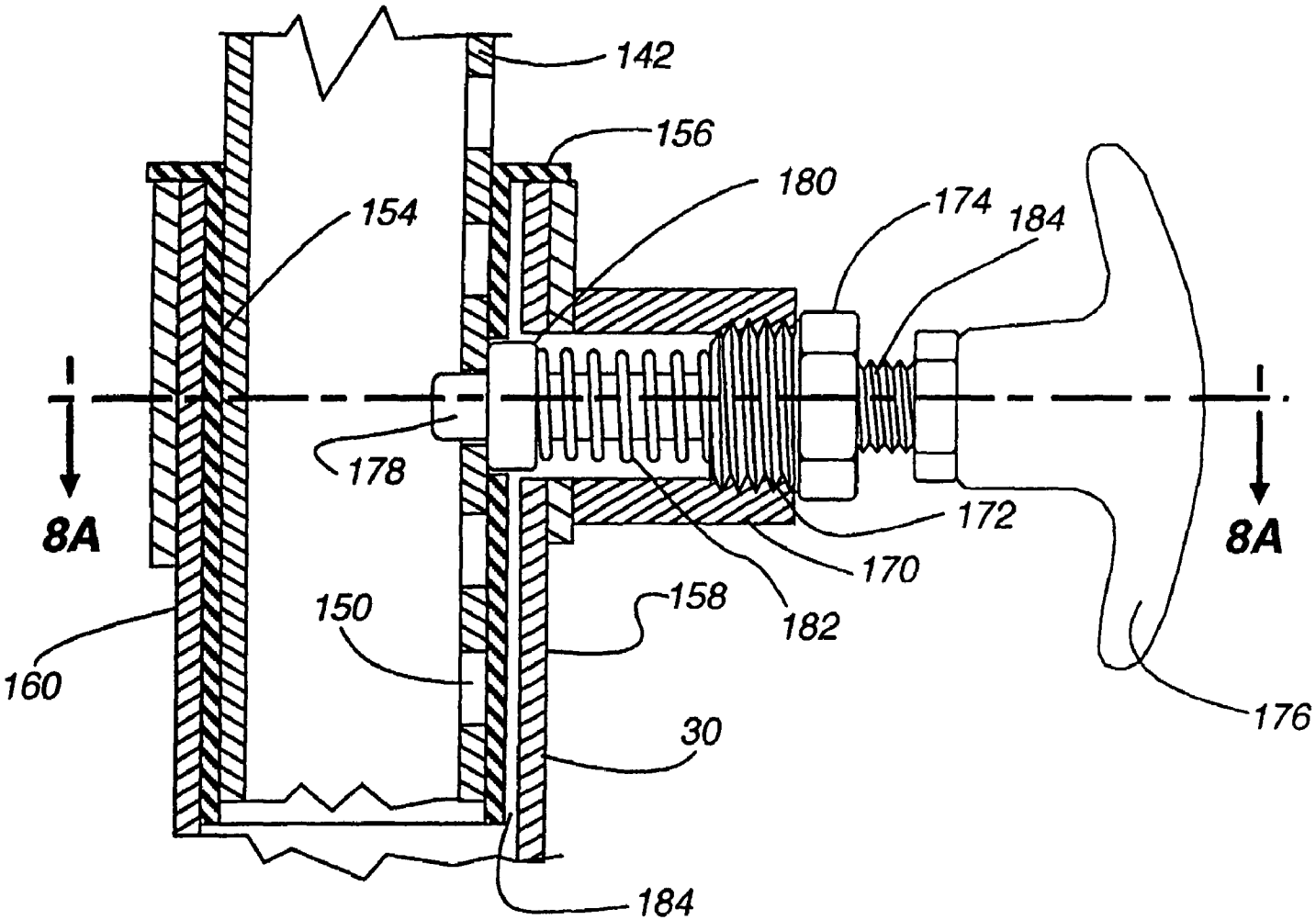
FIG. 7A is a section view taken along line 7—7 of FIG. 2 illustrating a pop pin in engagement with a head tube and a handlebar stem according to one embodiment of the invention.
Figure 7B:
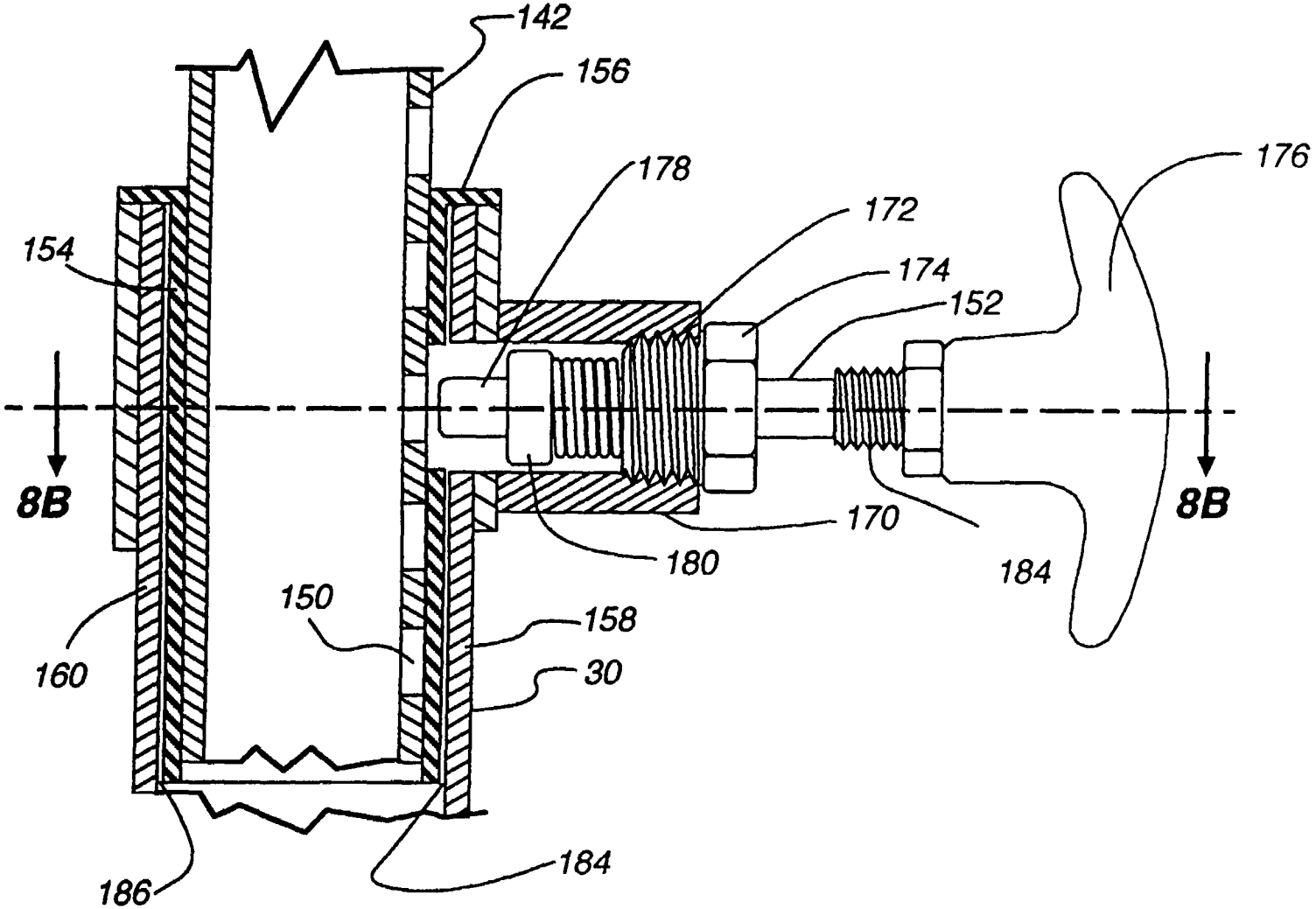
FIG. 7B is a section view taken along line 7—7 of FIG. 2 illustrating the pop pin disengaged from the handlebar stem according to one embodiment of the invention.
Figure 8A:
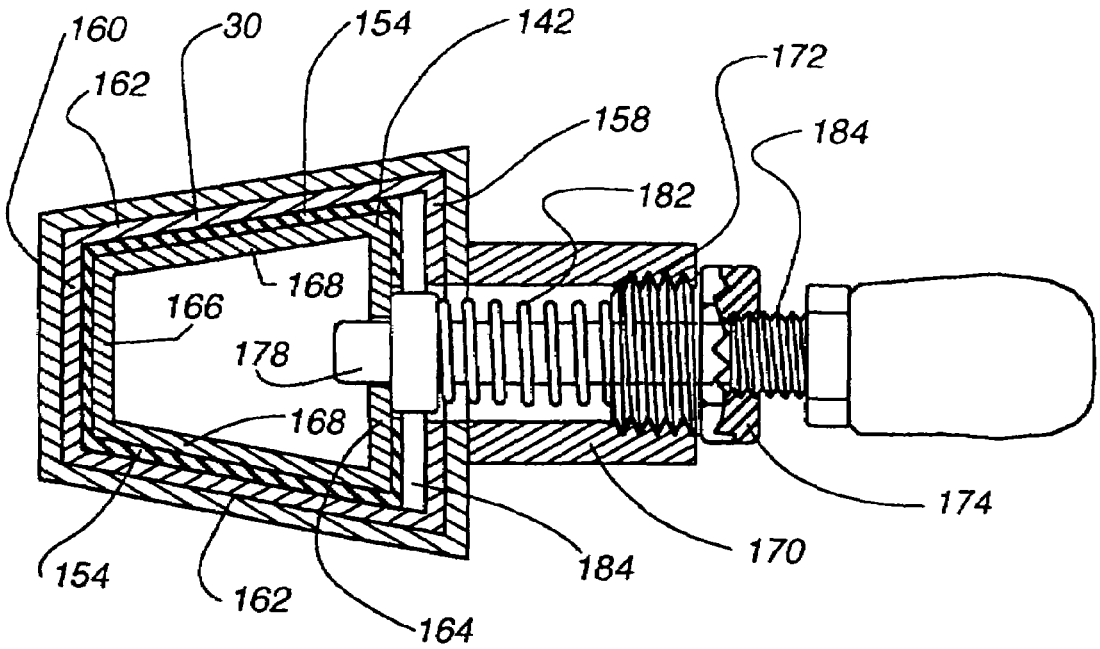
FIG. 8A is a section view taken along line 8A—8A of FIG. 7A.
Figure 8B:
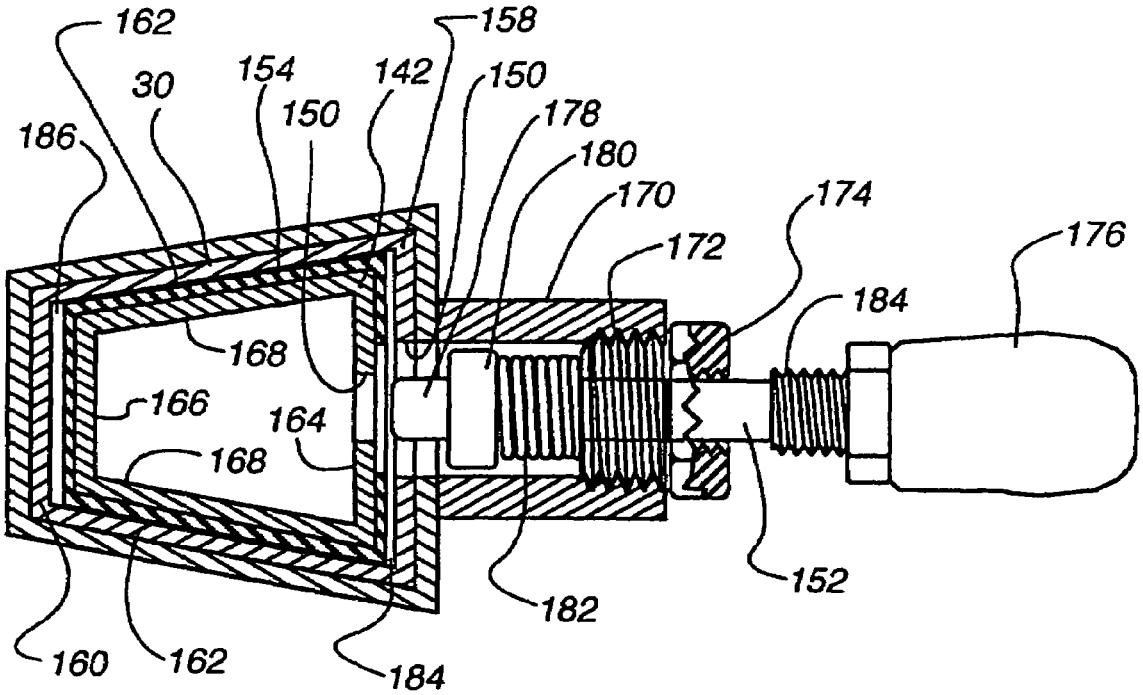
FIG. 8B is a section view taken along line 8B—8B of FIG. 7B.

FIGS. 7A and 7B are cross sections of the head tube 30 and handlebar stem 142 taken along line 7—7 of FIG. 2. FIGS. 8A and 8B are cross section of the head tube 30 and handlebar stem taken along line 8A—8A of FIG. 7A and along line 8B—8B of FIG. 7B, respectively. Referring particularly to FIGS. 4, 8A and 8B, in one embodiment, a front wall 158 of the head tube 30 is wider than a rear wall 160 of the head tube, and side walls 162 taper inwardly from the outside edges of the front wall 158 to the outside edges of the rear wall 160 to define a trapezoidal aperture adapted to receive the handlebar stem 142. The handlebar stem 142 or post is also trapezoidal and configured to be received by the head tube 30. In one embodiment, the stem 142 also includes a front wall 164 that is wider than a rear wall 166, and side walls 168 that taper inwardly from the outside edges of the front wall 164 to the outside edges of the rear wall 166. The width of the front 164 and rear 166 walls of the stem 142 are less than the width of the front 158 and rear 160 walls of the head tube 30, and the length of side walls 168 of the stem 142 are less than the length of the side walls of the head tube 30 so that the stem 142 will fit in the head tube 30. The front walls are generally parallel with the rear walls and the angles between the front walls and the side walls of each of the head and stem are nearly equal. Configured as interengaging trapezoids, the handlebar stem can positively engage at least two walls, and preferably three, of the head tube 30 for a secure fit.

The pop pin 152 is operably connected with the front wall 158 of the head tube 30. A boss 170 extends forwardly from the front wall 158 of the head tube 30 and defines a threaded aperture 172 for receiving a threaded sleeve 174. The sleeve 174 is cylindrical with the outer surface being threaded and adapted to threadably engage the threaded aperture 172 defined by the boss 170. The inner portion of the sleeve 174 is partially threaded, adjacent its front portion and is adapted to receive the pop pin 152. The pop pin 152 is milled at one end, opposite a handle 176, to define an engaging cylinder 178 and a collar 180. The engaging cylinder 178 is adapted to insert into one of the apertures 150 along the front wall 158 of the handlebar stem 142. The sleeve 174 is connected with the tightening bolt 152 by a spring 182 biased to insert the engaging cylinder 178 into one of the plurality of apertures 150 in the handlebar stem 142.

Both the insert 154 and the head tube 30 define apertures large enough for the collar 180 to pass through. The apertures in the front of the handlebar stem 142, however, are large enough to only receive the engaging cylinder 178 and not the collar 180. Accordingly, when the engaging cylinder 178 is in one of the apertures 150 of the stem 142, the collar 180 abuts the front wall 164 of the handlebar stem 142. The spring 182 forces the pop pin 152 into this position when properly aligned with one of the apertures. When the engaging cylinder 178 is through one of the apertures 150, an outer threaded portion 184 of the pop pin 152 abuts the threaded portion of the sleeve 174. Using the handle 176, the pop pin 152 may then be further tightened into the sleeve, which forces the collar 180 to press rearwardly on the stem 142 and thereby further secure the stem 142 in the head tube 30. The head tube 30 and stem 142 may be rearranged so that, for example, the wide walls of the tube and stem are to the rear and the pop pin extends forwardly.

As best shown in FIG. 8B, the distance between the front wall 164 and the rear wall 166 of the handlebar stem 142 is configured so that when it is inserted in the head tube 30 there is a front gap 184 between the front wall 158 of the head tube 30 and the front wall 164 of the handlebar stem 142 and a rear gap 186 between the rear wall 160 of the head tube 30 and the rear wall 166 of the handlebar stem 142, in one example. The distance between the sidewalls of the of the head tube, i.e., the width, is configured so that when the tightening bolt 176 is not engaged, such as when the handlebar stem 142 is first inserted in the head tube 30 or when the handlebar is being vertically adjusted, the handlebar stem 142 rests forwardly in the head tube 30 to provide the gaps as described.

When the pop pin is tightened into the sleeve 174, the handlebar stem 142 is wedged rearwardly in the head tube 30 widening the front gap 184 and closing (or nearly closing) the rear gap 186 as shown in FIG. 8A. Due to the inter-engaging trapezoidal tubing, when being wedged rearwardly, the side walls of the handlebar stem engage the respective side walls of the head tube. In one example, the sidewalls and the front and rear walls of the handlebar stem 142 are configured so that each sidewall will positively engage a substantial portion of the length of the sidewalls of the head tube 30 thus providing at least two walls of positive engagement. The head tube 30 and handlebar stem 142 may be configured to provide positive engagement between the rear wall of the head tube 30 and the rear wall of the handlebar stem 142 in the most rearward position within the head tube 30. In this manner, there is positive engagement between three walls of the head tube and the handlebar stem.

Other tube shapes, such as a triangle, a trapezoid with curved walls, a triangle with curved walls, and a star or other complex shape, may be used to provide the wedging effect achieved by the trapezoidal configuration described herein. Alternatively, the exercise bicycle of the present invention may also be fitted with a conventional cylindrical head tube and corresponding cylindrical handlebar post or a conventional square type head tube and corresponding square handlebar post. However, the trapezoidal tubing configured to provide a wedging effect provides a plurality of points of positive contact along entire longitudinal faces of the interengaging tubes, which reduces wobble, squeaking, and imparts overall improved stability to the structure as compared with cylindrical or square tubing. In the case of cyclindrical tubing there is typically only a limited area of positive engagement provided by a circumferential collar at the very top of the head tube (which is used to fix the cylindrical handlebar post at a particular height). Moreover, cylindrical tubing based head tube and handlebar post structures (and seat tube and seat post structures) can sometimes result in the handlebar being unintentionally rotated within the head tube during use, which is not possible with the trapezoidal tubing of embodiments of the invention. In the case of square tubing, there is typically only positive engagement along one wall of the square tube opposite the pop pin. As with the trapezoidal tubing, square tubing based head tubes and handlebar posts cannot result in unintentional rotation of the handlebars.

Referring to FIGS. 1–3, the seat assembly 36 includes a seat post 190 adapted to be adjustably mounted within the seat tube 34. A seat tube pop pin 192 is operably connected with the front wall of the seat tube 34. The seat tube pop pin 192 operates in the same manner as the pop pin 152 on the head tube 30, including having trapezoidal interengaging tubes. The seat post defines a plurality of apertures 194 along a front wall adapted to receive the seat tube pop pin 192 when the engaging cylinder is and aligned with one of the apertures. The apertures 194 in the front wall of the seat post 190 are sized to receive the engaging pin, but not the collar so that the collar will abut the front wall of the seat post when the engaging pin is inserted in one of the apertures, the same as the pop-pin structure in the head tube 30, as described above.

A rearwardly extending lateral adjustment tube 196 is connected with the top of the seat post 190. The lateral adjustment tube 196 defines an aperture 198 adapted to receive a lateral adjustment post 200. The seat 38 is connected to an S-shaped post 202 that extends rearwardly and upwardly from the front portion of the lateral adjustment post 200. In one example, a bottom wall of the lateral post 200 defines a plurality of apertures adapted to receive a seat pop pin 204 mounted on a bottom wall of the lateral tube 196. Accordingly, the seat 38 may be adjusted forwardly or rearwardly by disengaging the seat pop pin 204 and sliding the seat post 200 forwardly or rearwardly within the seat tube 196 and engaging one of the apertures in the seat post 200 corresponding with the desired lateral (forward or rearward) position of the seat 38.

A seat post insert 206, in one example, is fit between the seat tube 34 and the seat post 190. The seat tube insert 206 defines a flange 208 along its upper rim configured to rest on the top rim of the seat tube 34. A single large aperture 207 is defined along the front wall of the insert which aligns with the seat tube pop pin 192. The aperture is sized to receive both the engagement pin and the collar of the pop pin. A lateral tube insert 212, in one example, is also fit between the lateral tube 196 and the lateral post 200. The lateral insert 212 defines a flange 213 along its rear rim configured to engage the rear rim of the lateral tube. A single large aperture is defined along the lower wall of the insert which aligns with the seat pop pin 204. As with the other inserts, the aperture is sized to receive the engagement pin and the collar of the pop pin.

In one example, the seat tube 34 and the seat post 190, and the lateral tube 196 and the lateral post 200 use interengaging trapezoidal tubing structure described above to facilitate wedge engagement like the head tube 30 and handlebar stem 142 described earlier. As shown in FIG. 4, a front wall 215 of the seat tube is wider than a rear wall 217 of the seat tube, forming a trapezoid. A left 219 and a right 221 sidewall of the seat tube 34 converge toward each other between the outer edges of the front wall and the outer edges of the rear wall to define a trapezoidal aperture. The seat post 190 includes trapezoidal tubing adapted to fit within the trapezoidal aperture defined by the seat tube 34. In one example, the front wall of the seat post 190 is wider than the rear wall of the seat post, and the sidewalls taper inwardly between the outside edges of the front wall and the outside edges of the rear wall.

The seat post 190, in one example, is configured to be wedged rearwardly in the seat tube 34. The seat tube pop pin 192 is substantially similar to the pop pin 152 described as the head tube 30 and related structure and operation as shown in FIGS. 7A, 7B, 8A, and 8B. The engaging pin is adapted to engage one of the apertures 194 on the front wall of the seat post 190 to vertically position the seat. The spring is biased to push the engaging pin into one of the apertures. Biased in such a manner, the pop pin snaps into whatever apertures it is aligned with when the user is not pulling outward on the handle. Again, the operation of the interengaging trapezoidal seat tube 34 and seat post 190 work with the pop pin structure 192 identically to that shown in FIGS. 7A, 7B, 8A, and 8B.

Referring to FIG. 3, the lateral seat tube 196 extends rearwardly from the seat post 190 and is positioned generally horizontal when the seat post 190 is mounted within the seat tube 34. In one example, the seat mounting tube 196 includes a lower wall 223 having a greater width than an upper wall 225, and with a left side wall 227 and right sidewall 229 tapering upwardly from the outer edges of the lower wall to the outer edges of the upper wall to define a trapezoidal aperture 198 adapted to receive the lateral seat post 200.

The lateral seat post 200 is generally trapezoidal with an upper wall 230, a lower wall 232, and sidewalls 234 adapted to cooperate with the trapezoidal aperture defined by the lateral seat tube. In one example, when the lateral seat post 200 is loosely positioned within the seat mounting tube 196, there is an upper gap between the upper wall of the lateral seat mounting tube 196 and the upper wall of the lateral seat assembly post 200, and the lower wall of the lateral seat post 200 rests on the lower wall of the seat mounting tube 196.

The pop pin 204 extends downwardly from the rear portion of the lower wall of the lateral tube 196, and is housed in a boss 236 with a sleeve substantially similar or described with reference to the head tube 30. The lateral seat post 200 may be adjusted forwardly or rearwardly by moving it forwardly or rearwardly within the lateral seat tube 196 and fixing the seat assembly post in a desired position with the pop pin 204. The pop pin 204 is biased to draw the engaging pin into one of the apertures in the bottom of the lateral seat post 200. The pop pin 204 may then be tightened to force the collar upwardly against the bottom wall of the lateral seat post 200 and wedge the lateral seat post 200 upwardly between the sidewalls of the seat mounting tube 196. As the lateral seat post 200 is wedged upwardly, the upper gap closes and a lower gap opens, until the left and right side walls 234 of the lateral seat post firmly engage the left 227 and right 229 sidewalls of the lateral seat tube 196. In this manner, at least two sidewalls of the lateral seat post positively engage at least two sidewalls of the lateral seat tube. The tubes may also be configured so that the upper wall 230 of the seat assembly post 200 positively engages the upper wall 225 of the seat mounting tube 198 thereby providing three walls of positive engagement.

Figure 9:
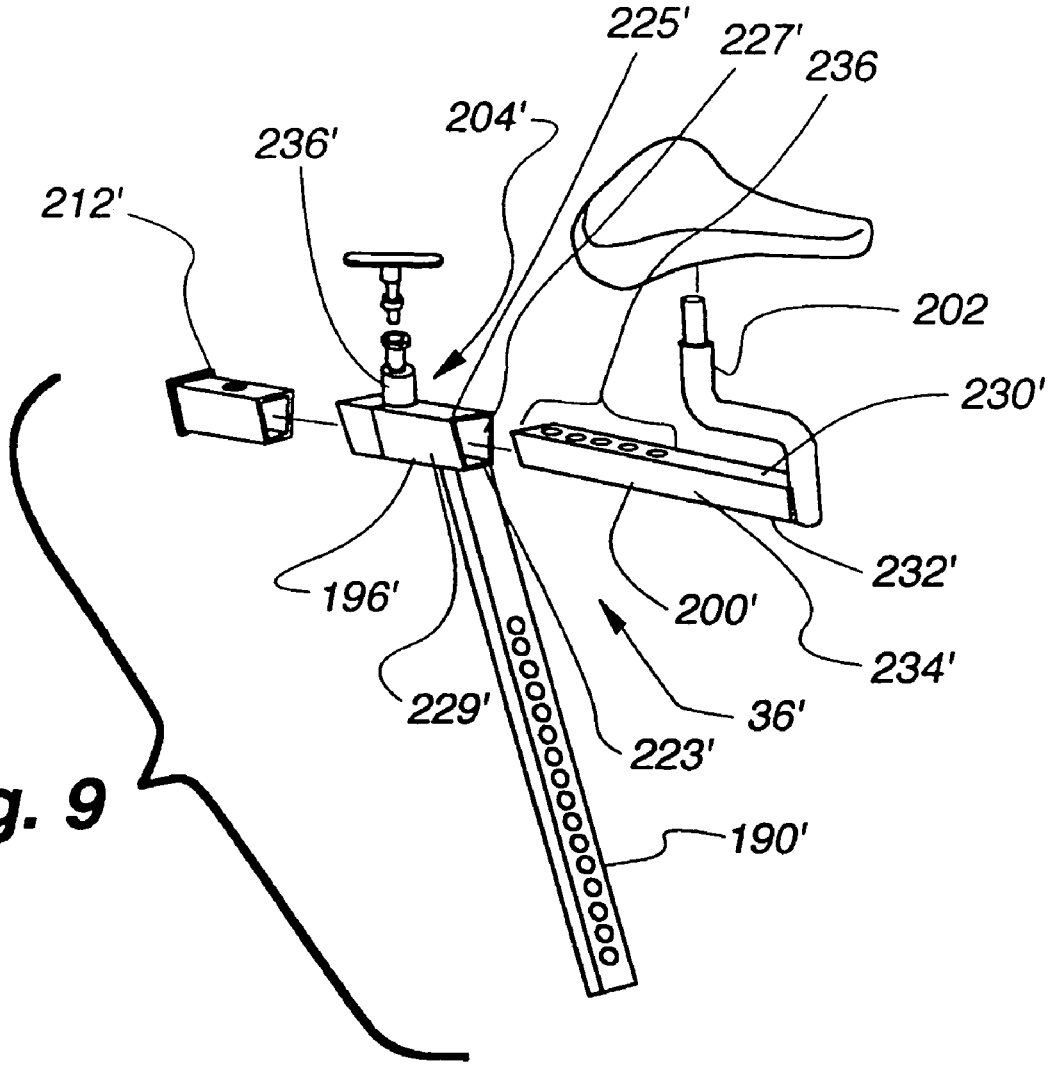
FIG. 9 is an exploded perspective view of a seat assembly according to one embodiment of the invention.

An alternative embodiment of the seat assembly 36' is shown in FIG. 9. In this example, the lateral seat tube 196' includes a lower wall 223' having a lesser width than the upper wall 225', and with a left side wall 227' and a right sidewall 229' tapering downwardly from the outer edges of the upper wall to the outer edges of the lower wall to define a elongate trapezoidal aperture adapted to receive the lateral seat post 200'. The lateral seat post 200' is also rearranged so that the upper wall 230' of the lateral seat post is wider than the lower wall 232', and the sidewalls 234' taper downwardly from the outside edges of the upper wall to the outside edges of the lower wall. The lateral seat post 200' defines a plurality of apertures 239 along its upper wall 230'.

The pop pin boss 236', in this embodiment, extends upwardly from the rear portion of the upper wall 225' and defines a threaded aperture that extends through the upper wall and is adapted to receive the sleeve. In this embodiment, when the pop pin 204' is tightened within the sleeve, it engages the upper wall 230' of the lateral seat post 200' and wedges the seat post downwardly within the lateral seat tube 196'. As the lateral seat post 200' is wedged downwardly, the left and right sidewalls 234' of the lateral seat post 200' firmly engage the left and right sidewalls (227', 229') of the lateral seat tube 196'. As with the first embodiment, at least two sidewalls of the lateral seat post positively engage at least two sidewalls of the lateral seat tube. The tubes may also be configured so that the lower wall 232' of the seat assembly post positively engages the lower wall 223' of the seat mounting tube thereby providing three walls of positive engagement. Again, in this embodiment, the pop pin and trapezoidal structure and operation are identical to that shown in FIGS. 7A, 7B, 8A, and 8B.

For either embodiment of the seat assembly or the handlebar assembly, additional pop pins may be provided, such as an additional pop pin near the forward portion of the lateral seat tube adjacent the downwardly extending seat post. In this manner, the lateral seat post may be wedged within the lateral seat tube in at least two locations.

Figure 10:
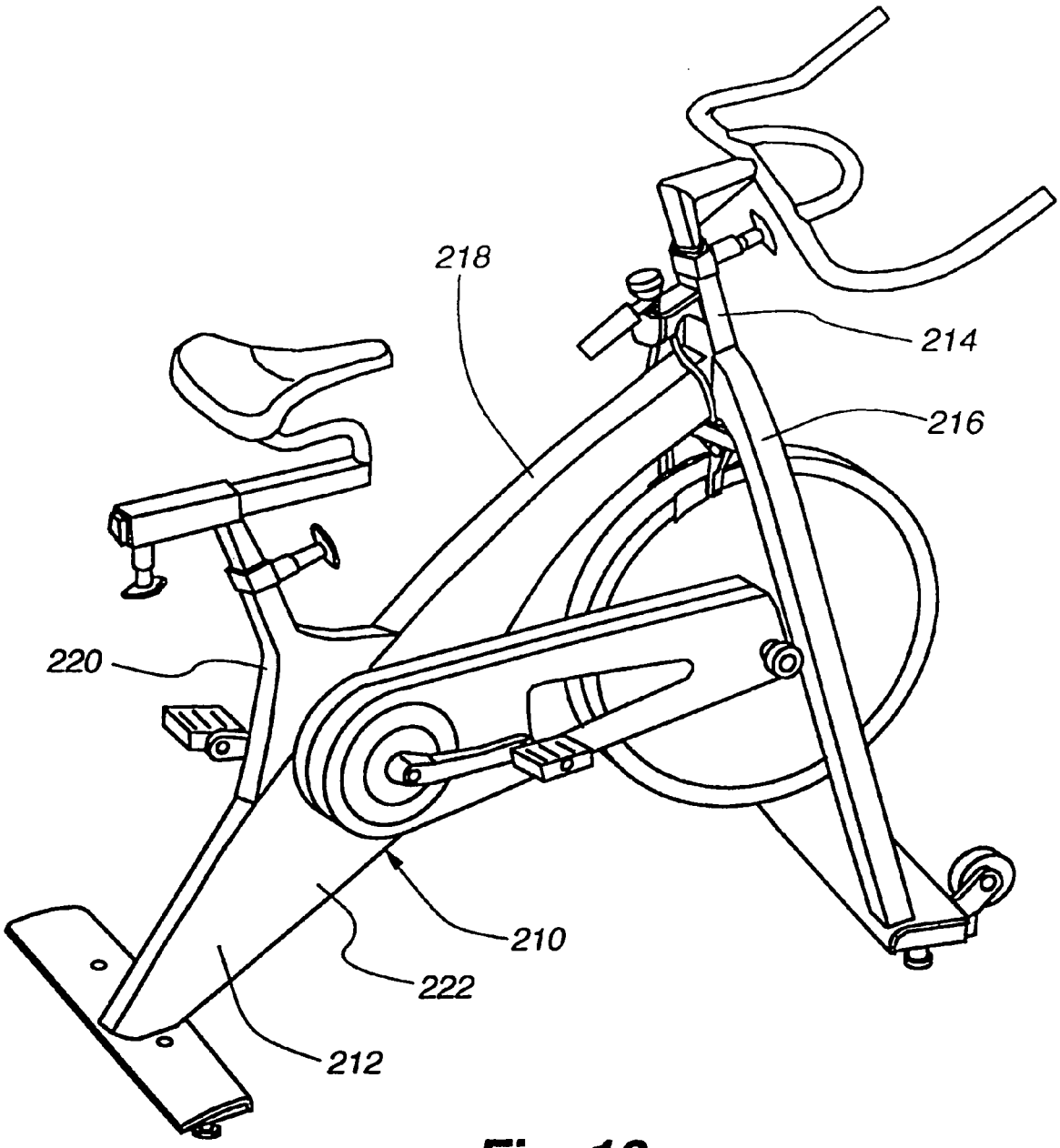
FIG. 10 is a perspective view of an alternative embodiment of the exercise bicycle according to the present invention.

FIG. 10 illustrates an additional alternative embodiment of the monocoque frame structure. In this embodiment, the bottom support and bottom tube structure is removed. The monocoque frame member 210 extends from the rear support 212 to the head tube 214 and forks 216, with the top support 218 being connected with the head tube 214. The seat support 220 extends upwardly between the rear support 212 and the top support 218. In this embodiment, the top support 218 may have a greater vertical dimension than the top support shown in FIGS. 1–5, to properly support the frame. This type of frame has a linearly extending profile made of the monocoque construction, and only has a rear support 212, a front support 218, and a drive assembly extending between the main body 222 and the flywheel. The rest of the structure of the exercise bicycle frame has the same structure and operation as previously described.

Although the present invention has been described with a certain degree of particularity, it is understood that the present disclosure has been made by way of example, and changes in detail or structure may be made without departing from the spirit of the invention as defined in the appended claims.

I claim:

1. An exercise bicycle frame comprising:

a rear support;

a top support extending generally forwardly and upwardly from the rear support;

a seat support extending generally upwardly from between the rear support and the top support;

a front fork connected with a forward end portion of the top support;

a tube comprising a seat tube at least partially received within the seat support, wherein the tube includes:

a first wall having a first edge and second edge;

a second wall having a third edge and fourth edge;

a third wall connected between the first edge and the third edge;

a fourth wall connected between the second edge and the fourth edge, wherein a first distance between the first edge and the second edge is greater than a second distance between the third edge and the fourth edge; and a post comprising a seat post supporting a seat wherein the post includes:

a first post wall having a first post edge and second post edge;

a second post wall having a third post edge and fourth post edge;

a third post wall connected between the first post edge and the third post edge;

a fourth post wall connected between the second post edge and the fourth post edge wherein a third distance between the first post edge and the second post edge is greater than a fourth distance between the third post edge and the fourth post edge; and wherein the seat post is partially received within the seat tube to provide selective vertical height adjustment of the seat.

2. An exercise bicycle frame comprising:

a rear support;

a top support extending generally forwardly and upwardly from the rear support;

a seat support extending generally upwardly from between the rear support and the top support;

a front fork connected with a forward end portion of the top support;

a tube comprising a head tube connected with the front fork wherein the tube includes:

a first wall having a first edge and second edge;

a second wall having a third edge and fourth edge;

a third wall connected between the first edge and the third edge;

a fourth wall connected between the second edge and the fourth edge wherein a first distance between the first edge and the second edge is greater than a second distance between the third edge and the fourth edge; and a post comprising a handlebar stem supporting a handle bar assembly wherein the post includes:

a first post wall having a first post edge and second post edge;

a second post wall having a third post edge and fourth post edge;

a third post wall connected between the first post edge and the third post edge;

a fourth post wall connected between the second post edge and the fourth post edge wherein a third distance between the first post edge and the second post edge is greater than a fourth distance between the third post edge and the fourth post edge; and wherein the handle bar stem is partially received within the head tube to provide for selective vertical height adjustment of the handle bar assembly.

3. The exercise bicycle frame of claim 1 wherein the first distance is greater than the third distance and wherein the second distance is greater than the fourth distance.

4. The exercise bicycle frame of claim 3 wherein the first wall is parallel with the second wall.

5. The exercise bicycle frame of claim 4 wherein the first post wall is parallel with the second post wall.

6. The exercise bicycle frame of claim 5 wherein an angle between the first wall and the third wall adjacent the first edge is substantially the same as an angle between the first wall and the fourth wall adjacent the second edge.

7. The exercise bicycle frame of claim 3 wherein the post fits within the first wall, the second wall, the third wall and the fourth wall of the tube.

8. The exercise bicycle frame of claim 7 wherein the tube includes a pop pin.

9. The exercise bicycle frame of claim 8 wherein the seat post defines a plurality of apertures.

10. The exercise bicycle frame of claim 9 wherein the pop pin is adapted to engage one of the plurality of apertures in the seat post.

11. The exercise bicycle frame of claim 10 wherein the pop pin is adapted to positively engage at least two of the post walls with at least two of the tube walls.

12. The exercise bicycle frame of claim 8, wherein the seat tube defines a first wedge configuration and the seat post defines a second wedge configuration adapted to cooperate with the first wedge configuration.

13. The exercise bicycle frame of claim 12, wherein the pop pin is adapted to wedge the seat post within the seat tube.

14. The exercise bicycle frame of claim 1, further comprising:

a forward/backward lateral adjustment post supporting the seat;

an adjustment tube operably connected with the seat support; and wherein the adjustment post is partially received within the adjustment tube to provide for selective forward/backward positioning of the seat.

15. The exercise bicycle frame of claim 2 wherein the first distance is greater than the third distance and wherein the second distance is greater than the fourth distance.

16. The exercise bicycle frame of claim 15 wherein the first wall is parallel with the second wall.

17. The exercise bicycle frame of claim 16 wherein the first post wall is parallel with the second post wall.

18. The exercise bicycle frame of claim 17 wherein an angle between the first wall and the third wall adjacent the first edge is substantially the same as an angle between the first wall and the fourth wall adjacent the second edge.

19. The exercise bicycle frame of claim 15 wherein the post fits within the first wall, the second wall, the third wall and the fourth wall of the tube.

20. The exercise bicycle frame of claim 19 wherein the tube includes a pop pin.

21. The exercise bicycle frame of claim 20 wherein the handlebar stem defines a plurality of apertures.

22. The exercise bicycle frame of claim 21 wherein the pop pin is adapted to engage one of the plurality of apertures in the handlebar stem.

23. The exercise bicycle frame of claim 22 wherein the pop pin is adapted to positively engage at least two of the post walls with at least two of the tube walls.

24. The exercise bicycle frame of claim 20, wherein the head tube defines a first wedge configuration and the handlebar stem defines a second wedge configuration adapted to cooperate with the first wedge configuration.

25. The exercise bicycle frame of claim 24, wherein the pop pin is adapted to wedge the handlebar stem within the head tube.

26. The exercise bicycle frame of claim 2, further comprising:

a forward/backward adjustment post supporting a seat;

an adjustment tube operably connected with the seat support; and wherein the adjustment post is partially received within the adjustment tube to provide for selective forward/backward positioning of the seat.

* * * * *